US005931310A

United States Patent [19]

Duggan

[11] Patent Number: 5,931,310

[45] Date of Patent: Aug. 3, 1999

[54] VIBRATING SCREEN FLOODED DECK SUPPORT STRUCTURE

[76] Inventor: John C. Duggan, 5995 Dover Rd., Lakeview, N.Y. 14085

[21] Appl. No.: 08/876,621

[22] Filed: Jun. 14, 1997

[51] Int. Cl.[6] ..... B07B 1/50

[52] U.S. Cl. ..... 209/380

[58] Field of Search ..... 209/268, 269, 209/273, 380, 409, 412

[56] References Cited

U.S. PATENT DOCUMENTS

| | | | |
|---|---|---|---|
| 955,898 | 4/1910 | Petsche | 209/273 X |
| 2,914,175 | 11/1959 | Fink | 209/269 |
| 3,454,162 | 7/1969 | Cover | 209/269 |
| 4,692,240 | 9/1987 | Arbuthnot et al. | 209/380 X |

*Primary Examiner*—David H. Bollinger

[57] ABSTRACT

A deck support framework system, being sectioned or modular, having one or more flooded support tubes 30A/30B. Flooded support tube 30A/30B is oriented essentially horizontal and attached at sides of a deck framework, aligned with fluid passage hole small 34A or threaded input hole 102 in the sides of a deck framework, allowing for the spraying of fluids through flooded support tube 30A/30B which has fluid exit holes 34B. Additionally or alternately a structural support for a vibrating screen or similar device, having one or more flooded support tubes 30A/30B, and having attached end members having fluid passage holes small 34A or threaded input hole 102, and having flat planar sides uttermost, or nearly so, with attached end members located at the open end portions of flooded support tube 30A/30B enabling the mounting of such a flooded structural support to vibrating screen side walls 50. Fastener holes are positioned as needed for both structural and fluid supply considerations in mating components.

15 Claims, 7 Drawing Sheets

VIBRATING SCREEN FLOODED DECK SUPPORT STRUCTURE

BACKGROUND—FIELD OF INVENTION

This invention relates to vibrating screens, specifically to the internal deck framework support structures and to spray bars for fluid spraying.

BACKGROUND—DISCUSSION OF PRIOR ART

Vibrating screens are used to sort particles and other materials commonly known as aggregates. This sizing is accomplished by causing materials to be sorted to vibrate over same type of porous surface. Aggregate particles that fall through openings in a porous surface are of one size and particles that do not fall through, but pass over these same openings are of another size.

Vibrating screens employ gravity in part to accomplish their sorting/sizing. This determines the orientation of porous surfaces over which aggregates flow. The orientation of porous surfaces is such that surfaces with larger openings are higher in vibrating screens. This orientation is accomplished in layers called decks. Decks are typically composed of some type of porous planar sheets, such as wire cloth, with a supporting framework underneath. Decks that are higher in a vibrating screen have larger openings or pores than lower decks. An example of this is a machine with two decks, one of 4 inch openings and another of 2 inch openings. When a particle of 3 inches is vibrated over the top deck it will fall through a 4 inch opening to the bottom deck and pass over the 2 inch openings and exit the machine.

Two basic different types of deck support frameworks are used in vibrating screens: single-piece and multiple-pieced. Single-piece frameworks are essentially continuous with structural members being permanently joined together forming one large framework. Multiple-pieced frameworks are discontinuous or modular, each deck comprising several individual frameworks. Multiple-pieced frameworks are known as support trays and have certain advantages over single-pieced frameworks. Single-pieced frameworks are large and heavy making replacement costly. Support trays are ideal for replacement being easier to handle and more cost effective.

A third type of vibrating screen deck framework support structure is a combination of both single-pieced and multiple-pieced designs. A typical combination design comprises a series of support trays having long, thin, continuous structural members attached on top. Typically the long, thin structural members rest upon and are welded to support trays and directly support whatever screening media is employed.

Vibrating screens which have the capability of spraying fluids are sometimes called "wet screens". This spraying of fluids is accomplished by the use of spray distributing items called spray bars. Spray bars are long, thin, tubular members, often made of pipe, that provide fluid spray inside vibrating screens. Spray bars are located above the deck that they spray down upon. Consequently spray bars are located between decks in machines with multiple decks. The uppermost deck also has spray bars mounted above it. Spray bars are typically oriented cross wise in a vibrating screen, passing through and normal to, machine side walls. A variety of methods for supporting spray bars and supplying fluids to spray bars exist in the prior art. Basically two different methods of supporting spray bars exist—moving or stationary.

In moving designs spray bars are typically attached to vibrating screen side walls directly and move with the vibrating screen. Holes are located between decks in side walls and are larger than spray bars to allow for replacement. Brackets, clamps, fasteners, shields around spray bars and other related hardware comprise the supporting means. Spray bars for the uppermost deck in this type of system are mounted directly to the top of the side walls usually. Fluid is supplied to all spray bars through a common manifold that is stationary. Manifold ports have flexible hose for distribution to spray bars. Spray bars of this design are subject to flexing from machine motion requiring spray bar reinforcement, especially in larger machines.

In stationary designs spray bars are attached to stationary frameworks independent of a vibrating screen body. In stationary designs body side walls have very large clearance holes allowing for machine movement around fixed spray bars. Such clearance is for movement during operation and for extreme movements during stopping and starting when passing through "crossover" or natural frequencies. Large holes require very large flexible hole shields to prevent the loss of material being sorted. Fluid supply is accomplished through manifold and flexible hose to spray bars. Holes through which spray bars pass have large reinforcing rings to prevent side wall fractures at holes.

Regardless of the type of deck support framework system, or the type of spray bar system used, many disadvantages exist in the prior art. Some of the disadvantages of the present wet type vibrating screen designs are:

(a) The use of spray bars placed between decks of a vibrating screen is space inefficient. Locating spray bars between decks has been the only logical choice thus far but it has in general a two fold spatial disadvantage. First it limits the number of decks for a given size of machine or it prevents a more compact size of machine. Second it prevents access for service workers to change wire cloth, clamp bars, spray nozzles, fasteners, . . . etc.

(b) Spray bars have been used for the purpose of spraying fluids in wet screen designs. They have to be purchased and manufactured initially and maintained and purchased as a replacement part. Though not an apparent impediment, their elimination would be a benefit for both manufacturers and end users.

(c) Holes in vibrating screen side walls for the admission of spray bars have been a source of trouble in both dynamic and static wet screen designs. The size of holes in side walls of moving spray bar designs are larger than spray bars—typically enough to remove/install spray bars with nozzles attached. Stationary spray bar type side walls have very large holes to allow for machine side wall motion. The result of both these designs are open areas between spray bars and side walls, which if not covered will allow aggregate particles to spill out. To counter this problem moving spray bar designs have hole shields, made typically of metal, which fit the contour of the spray bars and fasten to machine side walls. Stationary spray bar designs have a bigger problem in that they have to shield a larger open area which changes continually due to motion of the side walls. Typically this is accomplished through large, round, polyurethane skirts, which fit over spray bars and are allowed to rub against the side walls of a vibrating screen. The location of spray bar holes between decks is undesirable in both designs due to the stresses on side walls between decks. To counter this problem spray bar holes are reinforced typically by a ring of metal which generally follows the contour of the hole and is welded to a vibrating screen side wall.

(d) In moving spray bar designs spray bars are mounted directly to the vibrating screen body and thus require brackets and related hardware. Typically angular members are mounted at all spray bar hole locations having holes for U bolts and fasteners, thus providing spray bar mounts. Center brackets are typically required in wider machines to prevent excessive deflection and subsequent fatigue and fractures of spray bars, U bolts and other hardware. Typically such brackets are mounted by same means to the deck immediately above the spray bar at center of the bar. These components all have to be purchased and manufactured initially and purchased and maintained by the end user. The elimination of these parts would help both the end user and manufacturer.

(e) In moving spray bar designs the uppermost spray bars serving the top deck (fixed to the vibrating screen body) typically have no center brace. The reason is the absence of an above deck to anchor to. To counter deflection of top deck spray bars sane embodiments use structural members for reinforcement. Such reinforcement is typically an angle or other relatively light weight member welded or fastened to the spray bar increasing the stiffness against transverse loads/inertia. As vibrating screens have evolved, the size of machines has grown, especially in width. This requirement has become more prevalent, and will become more so as this trend continues.

(f) Protection for all types of spray bars from abrasion is a concern and two basic methods are available to protect spray bars. One method of protection shields spray bars by structural deck members in the deck above a spray bar. In such a method the location of the spray bar can help to protect it, but this is not very effective nor is it always possible to do. Spray bars have to be located away from drive guards, motors, side wall reinforcing members, drive tubes, . . . etc. Another method of protection for spray bars employs a physical shield made of metal, rubber or a metal plate with a rubber face. Such a method adds to the cost of a spray bar. Most often spray bars have no protection and are just replaced when worn. Replacement is costly.

(g) Fixed (non moving) spray bar designs have an inherent disadvantage in that a support framework is needed. Such a framework is like an external "skeleton" having framework members outside a vibrating screen body. The framework typically is spaced some distance away from machine side walls, allowing for body motion. A typical support framework has tiers of supporting framework members for each row of spray bars, with vertical members supporting the tiers. Typically the framework has brace members spanning the top over a vibrating screen and joining both sides of framework. Essentially this forms a framework having members that roughly form a three sided box-like structure. Spray bar support frameworks are typically mounted to a vibrating screen support base. Support frameworks for spray bars are expensive to manufacture and impede vibrating screen maintenance.

OBJECTS AND ADVANTAGES

Accordingly, several objects and advantages of my invention are:

(a) to provide a means for spraying fluids within a vibrating screen allowing the closer spacing of decks and/or allowing more decks per machine;

(b) to provide a means for spraying fluids within a vibrating screen with out spray bars;

(c) to provide a means for spraying fluids within a vibrating screen requiring smaller holes in vibrating screen side walls;

(d) to provide a means for spraying fluids within a vibrating screen having better side wall hole locations;

(e) to provide a means for spraying fluids within a vibrating screen requiring no side wall hole shields or hole skirts;

(f) to provide a means for spraying fluids within a vibrating screen eliminating the need for side wall hole reinforcing rings;

(g) to provide a means for spraying fluids within a vibrating screen requiring no spray bar side wall mounting angle brackets;

(h) to provide a means for spraying fluids within a vibrating screen requiring no spray bar mounting U bolts or related fasteners;

(i) to provide a means for spraying fluids within a vibrating screen requiring no spray bar protector or reinforcer;

(j) to provide a means for spraying fluids within a vibrating screen requiring no spray bar center brace/bracket;

(k) to provide a means for spraying fluids within a vibrating screen requiring no spray bar supporting framework; and (l) to provide a means for spraying fluids at an uppermost deck of a vibrating screen, employing flooded side wall support members located above that deck.

Further objects and advantages are to provide a means contained within a deck framework support structure, for spraying fluids at a subsequent or lower deck, for spraying fluids at an area below the lowest deck in a vibrating screen, which eliminates the need for spray bars for spraying fluids, and which provides the option for spraying fluids at the underside of porous screening media of the same deck for anti clogging and/or motion assistance of particles being sorted. Still further objects and advantages will become apparent from a consideration of the ensuing description and drawings.

DRAWING FIGURES

In the drawings, closely related figures have the same number but different alphabetic suffixes. Typically the structures shown are of a metal composition but are not limited strictly to metals but can also be manufactured of a variety of available structural materials. The "FLOW" vector shown in all figures represents the typical, general direction of aggregate flowing over a vibrating screen deck. Welds/bonding agents for components are not shown in the drawing figures.

Figure 1:
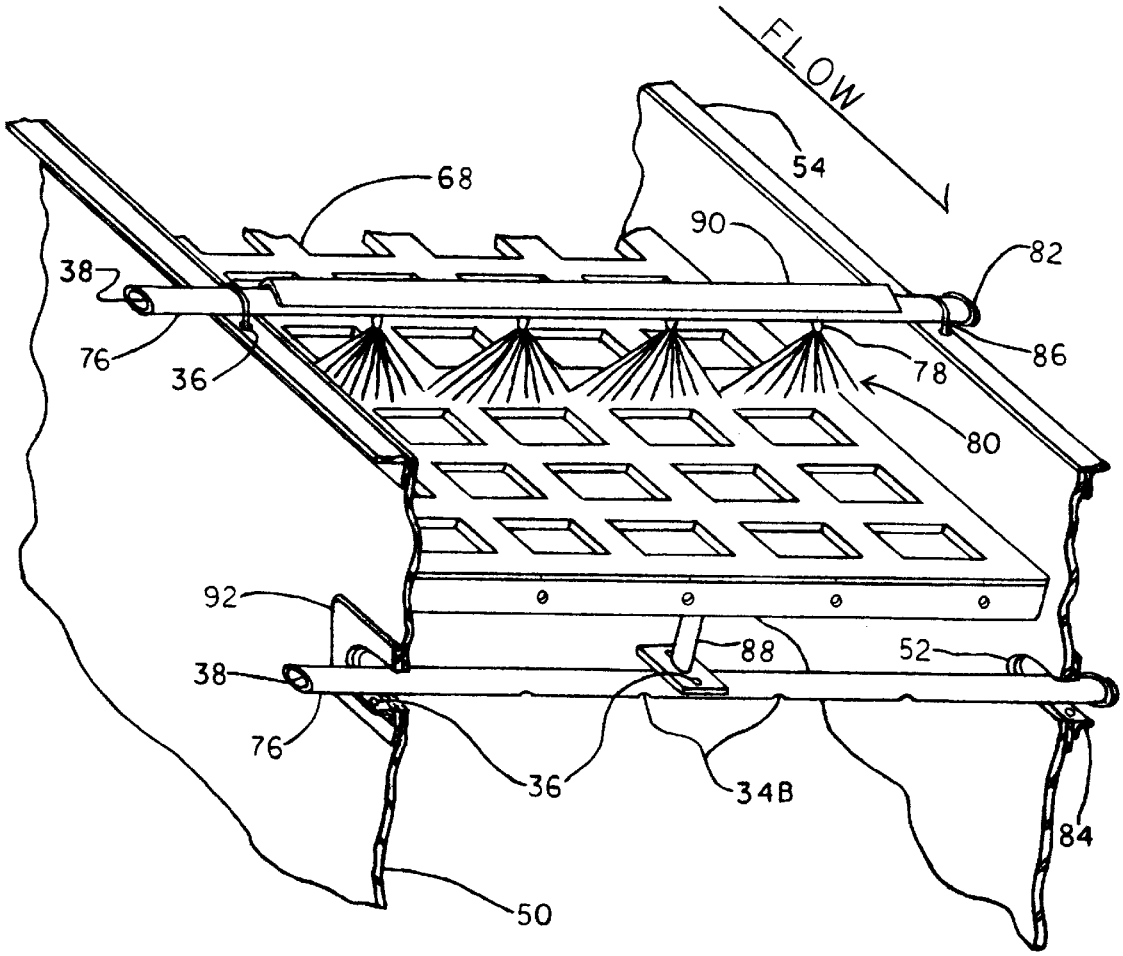
FIG. 1 PRIOR ART
FIG. 1 is PRIOR ART and shows a partial oblique view of a typical installation of prior art spray bars mounted in a vibrating screen body.
Figure 2:
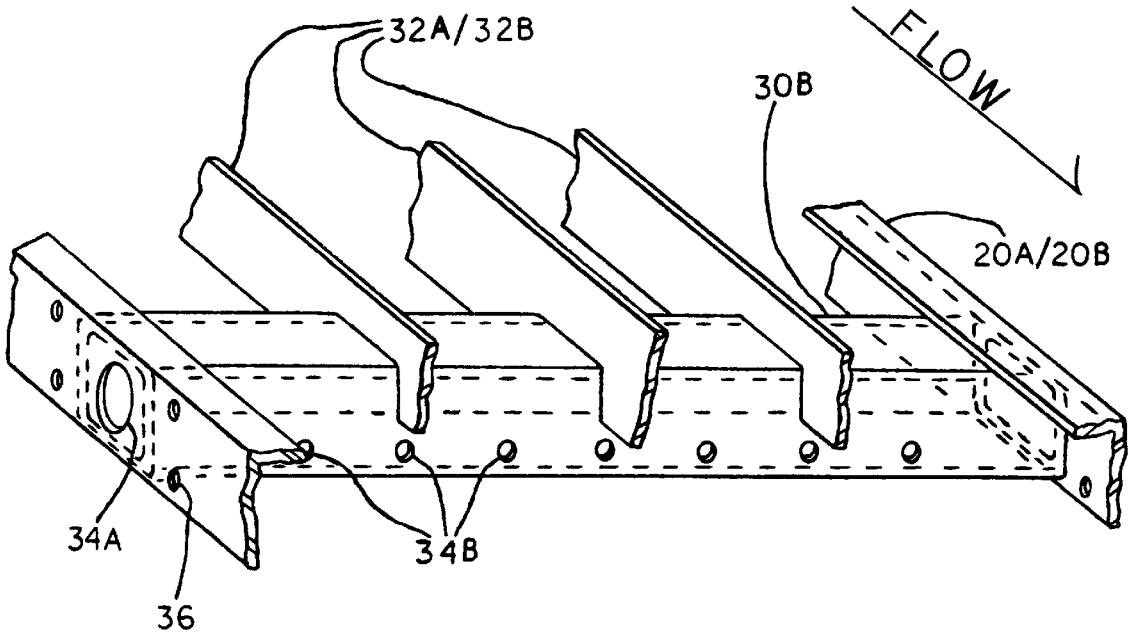
FIG. 2 and FIG. 6 are partial oblique views of an embodiment of my improved vibrating screen deck support structure employing a flooded internal tubular member for spray applications.
Figure 3:
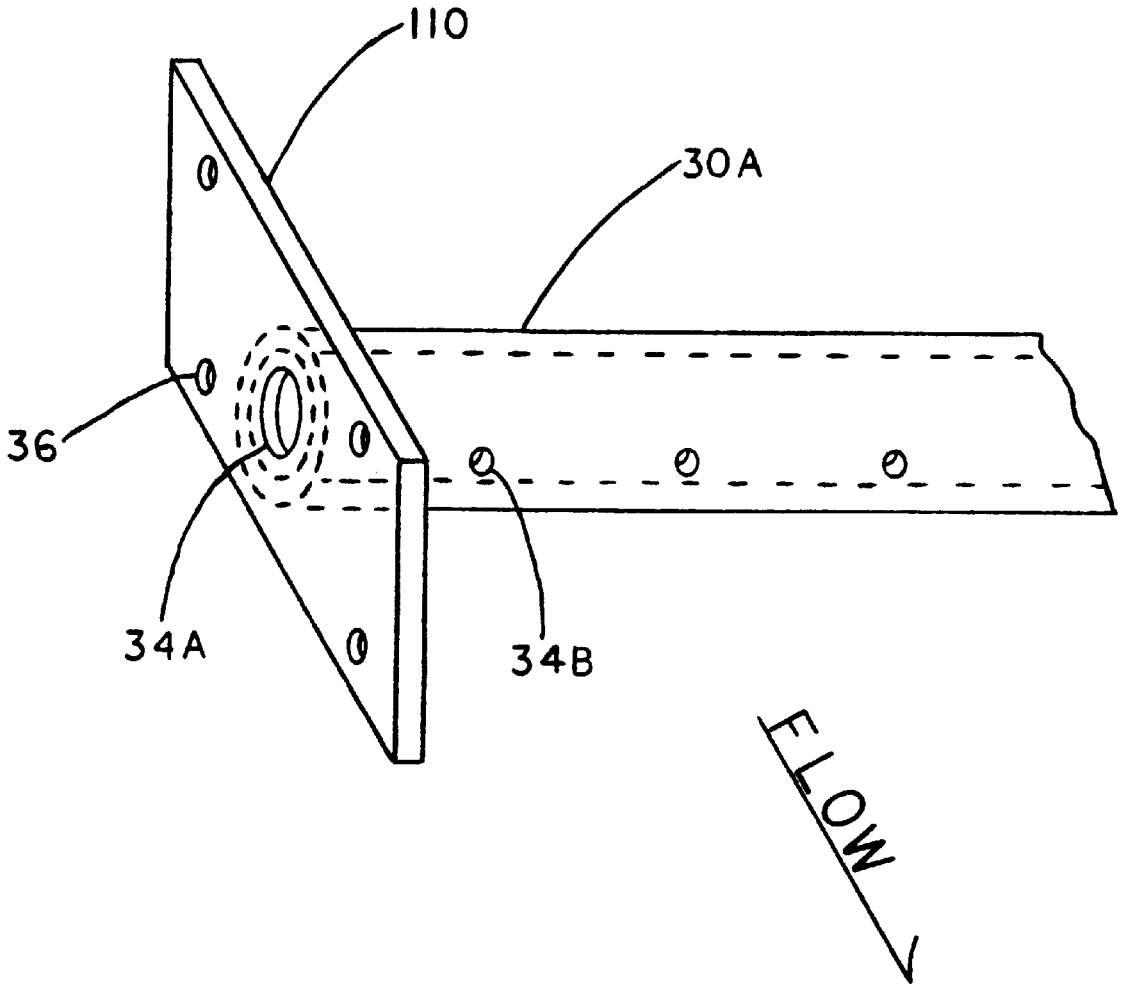
FIG. 3 and FIG. 7 are partial oblique views of an embodiment of my improved vibrating screen structural support employing a flooded tubular member for spray applications.

| REFERENCE NUMERALS IN DRAWINGS | |
|---|---|
| 20A | modular side angle |
| 20B | continuous side angle |
| 22 | framework end member |
| 30A | round flooded support tube |
| 30B | rectangular flooded support tube |
| 32A | modular support bar |
| 32B | continuous support bar |
| 34A | fluid passage hole small |
| 34B | fluid exit hole |
| 36 | fastener hole |
| 38 | open tube end |
| 50 | side wall |
| 52 | side wall bar hole |
| 54 | top side wall angle |
| 68 | perforated plate |
| 76 | spray bar |
| 78 | spray nozzle |
| 80 | fluid spray |
| 82 | spray bar end cap |
| 84 | spray bar angle barcket |
| 86 | U bolt |
| 88 | spray bar center brace |
| 90 | spray bar reinforcer |
| 92 | hole reinforcing ring |
| 94 | O ring |
| 96 | flange plate |
| 98 | pipe stub |
| 100 | threaded pipe nipple |
| 102 | threaded input hole |
| 108 | fluid passage hole large |
| 110 | flat end plate |

FIG. 4—PRIOR ART—DESCRIPTION OF PRIOR ART MOVING

SPRAY BARS/OPERATION OF PRIOR ART MOVING SPRAY BARS

Figure 4:
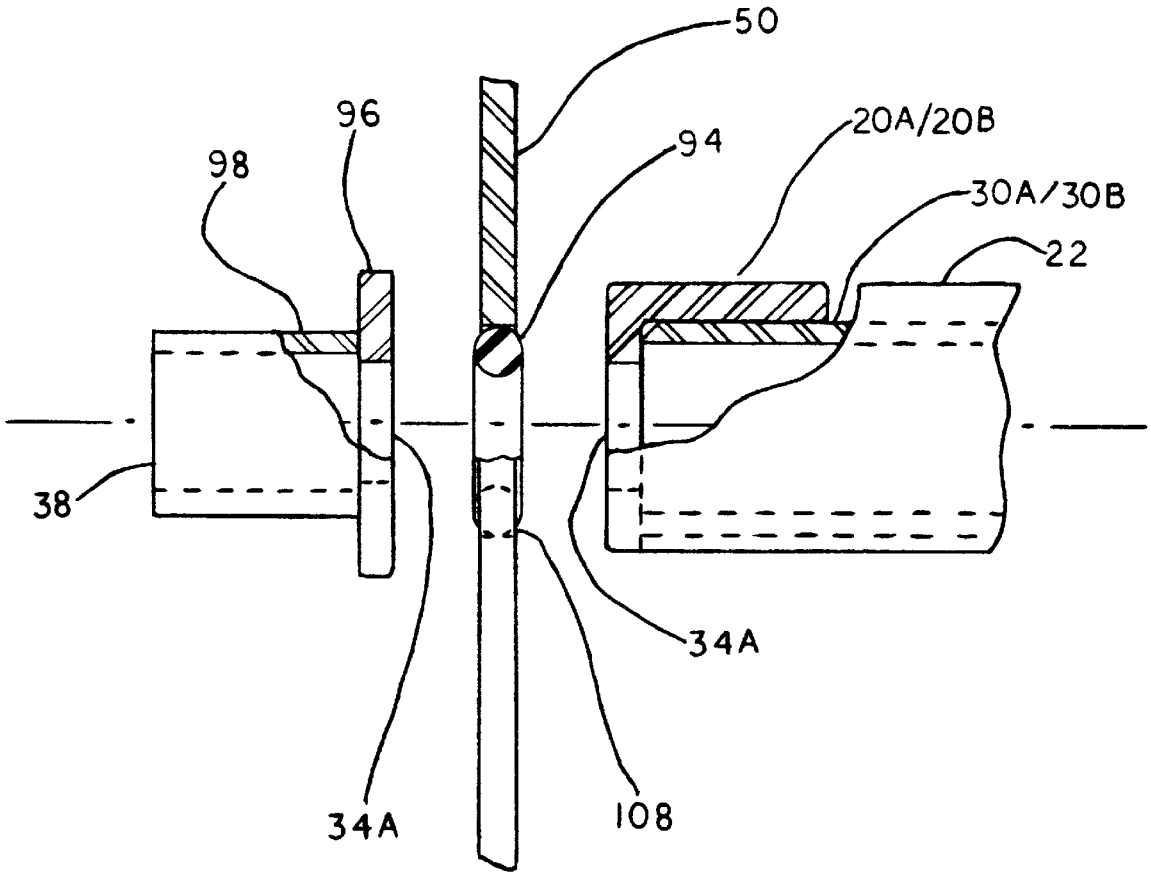
FIG. 4 is a partial, broken, end view of a vibrating screen employing an embodiment of my improved vibrating screen flooded deck support structure with a flanged pipe fluid supply member.
Figure 5:
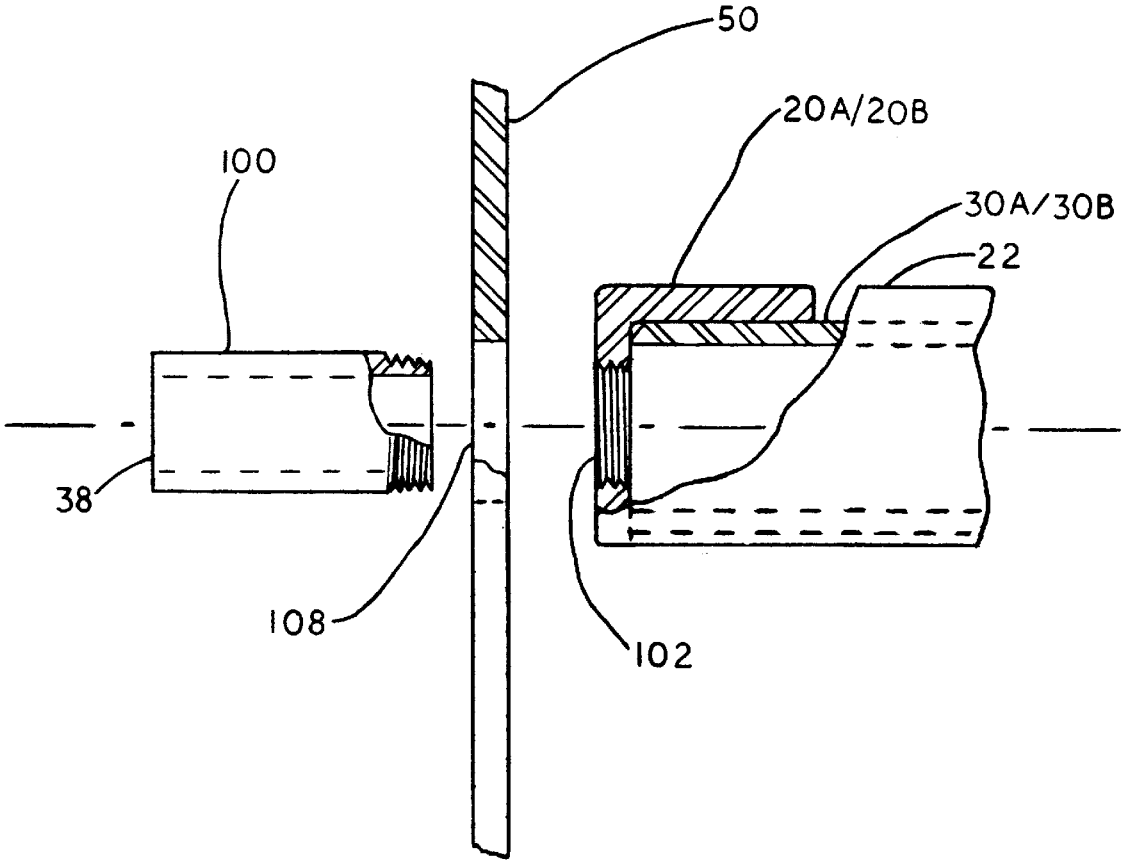
FIG. 5 is a partial, broken, end view of a vibrating screen employing an embodiment of my improved vibrating screen flooded deck support structure with a threaded pipe fluid input supply member.
Figure 6:
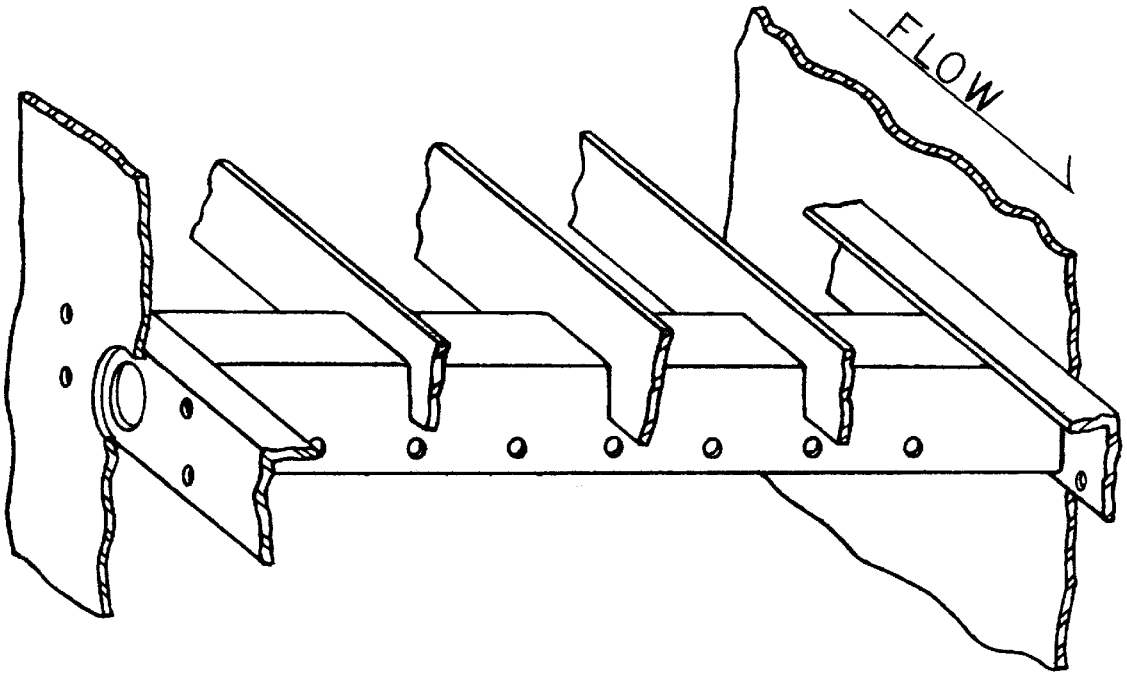
Figure 7:
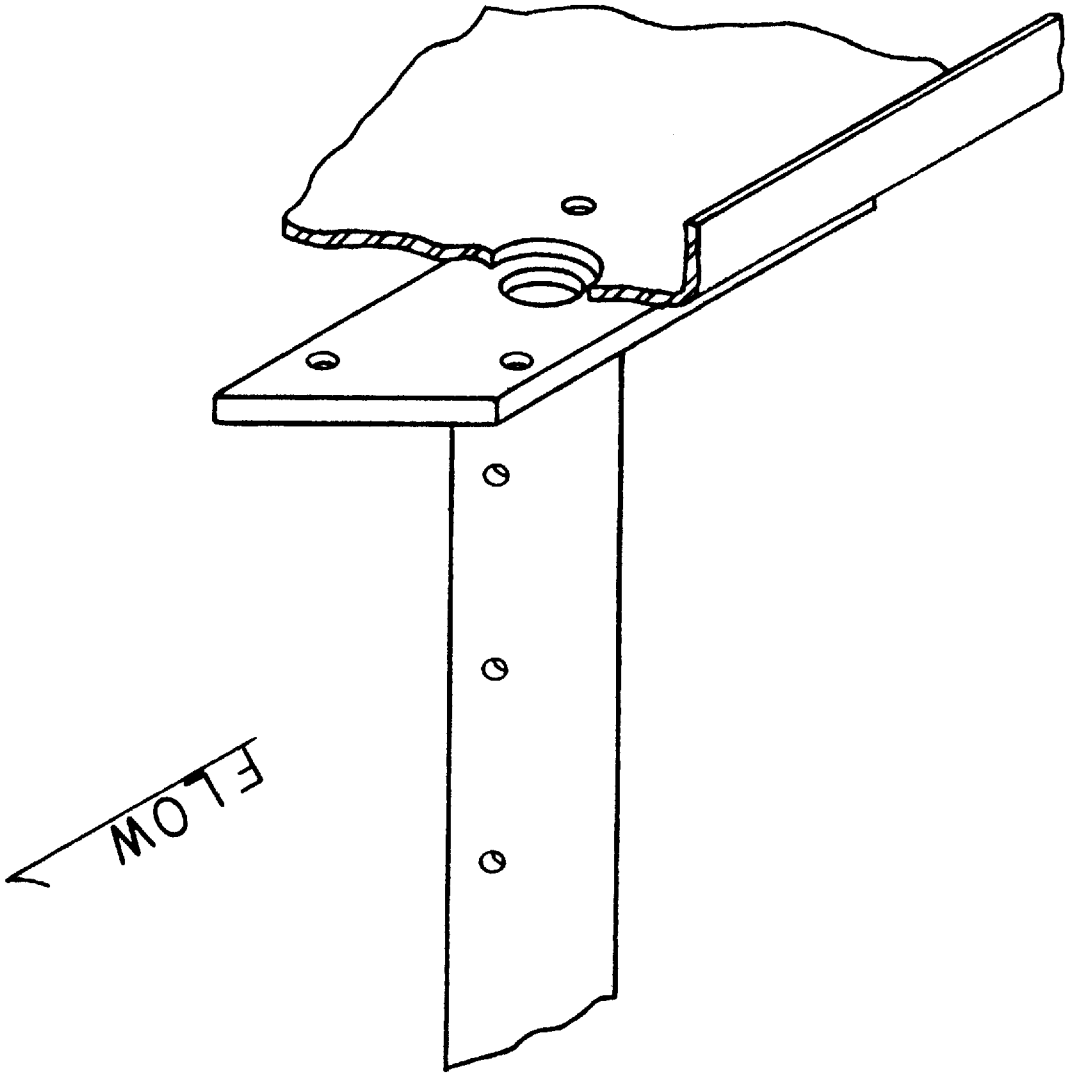

Description of Prior Art Spray Bar (FIG. 4)

FIG. 4 is prior art. Shown in FIG. 4 is a partial, oblique view of a typical vibrating screen employing spray bars 76. The general flow of aggregate over the deck surface shown is established by the "FLOW" vector. Most of the components of a vibrating screen are not shown in FIG. 4 but are removed to better reveal spray bars 76 and their locations. In FIG. 4 two spray bars 76 are shown attached in two different locations. Spray bars 76 are typically hollow pipes having open tube ends 38 at least at one end to receive fluid. Fluid spray 80 is shown being provided for an upper deck by a spray bar 76 located above two side walls 50 and attached to two top side wall angles 54. Fluid spray 80 is shown spraying above perforated plate 68 of an upper deck. For simplicity no aggregate particles are shown in FIG. 4. Spray bars 76 for an upper deck are attached by U bolts 86 through fastener holes 36 to top side wall angles 54.

A lower deck shown in FIG. 4 has a spray bar 76 located below an upper deck and above the next lower deck (not shown). Side wall bar holes 52, between decks, allow the passage of spray bars 76 through side walls 50. Spray bar angle brackets 84 are attached to side walls 50 by various means. Spray bars 76 are attached to spray bar angle brackets 84 by U bolts 86. Spray bar end caps 82 close off ends of spray bars 76 opposite open tube end 38 and are typically threaded pipe fittings. Spray bars 76 have fluid exit holes 34B which supply spray nozzles 78 with fluid spray 80. Fluid exit holes 34B are partially shown in the lower spray bar 76 in FIG. 4 and are not visible in the upper spray bar 76 due to presence of spray nozzles 78. For simplicity, lower spray bar 76 in FIG. 4 has no spray nozzles 78. Side wall bar holes 52 are sometimes oval and sometimes round. In either case side wall bar holes 52 are typically larger than spray bar 76 diameters to allow for installation/removal of spray bars 76—typically with spray nozzles 78 attached.

Spray bar hole shields (not shown in FIG. 4) are usually attached to side walls 50 or spray bar hole reinforcing ring 92 or spray bars 76. This blocks an open space between spray bar 76 and side wall bar holes 52 and prevents the loss of aggregate particles (also not shown in FIG. 4). Shown attached to upper spray bar 76 is a spray bar reinforcer 90. A spray bar center brace 88 is shown providing support to lower spray bar 76 in FIG. 4. Spray bar reinforcer 90 is typically a metal angle joined to a spray bar 76 by welding to strengthen spray bar 76 from excessive deflection. On wider machines the need for spray bar center braces 88 and spray bar reinforcers 90 is more pronounced. Typically a spray bar center brace 88 is made of metal and connects spray bars to the deck framework immediately above. A portion of the spray bar center brace 88 typically has fastener holes 36 to accommodate a U bolt 78 which joins spray bars 76 to spray bar center braces 88.

Operation of Prior Art Spray Bar (FIG. 4)

A fluid supply manifold, not shown in FIG. 4, typically supplies fluid for spray bars 76. Typically a supply manifold is elevated upon a fixed framework and has a number of outlet ports which supply spray bars 76. Flexible hose, not shown in FIG. 4, joins manifold ports to open tube ends 38 of spray bars 76. Typical prior art spray bars 76 as shown in FIG. 4 receive spraying fluid under pressure through open tube end 38. Typically spray bars 76 have spray bar end caps 82 on an end opposite the fluid input hole 34A. Pressurized fluid is distributed to a series of fluid exit holes 34B which usually have spray nozzles 78 attached to disperse fluid over aggregate particles (not shown in FIG. 4). Spray bars 76 spray fluid, typically for washing, on aggregate particles being sorted on a deck surface immediately below the location of spray bars 76. Spray bars 76 shown in FIG. 4 are rigidly mounted to, and move with, vibrating screen side walls 50. Spray bar reinforcer 90 is mounted to spray bar 76 and counteracts the stresses incurred during operation and in some applications may also protect spray bars from aggregate particles 56.

Vibrating screen side walls 50 have side wall bar holes 52 typically large enough to allow the installation or removal of spray bars 76 typically with attached spray nozzles 78. Hole reinforcing rings 92 are often needed to strengthen side wall bar holes 52 which are located in an area between deck frameworks. Spray bar hole shields (not shown in FIG. 4) close off the area between side walls 50 and spray bars 76 preventing the loss of aggregate particles 56. Typically spray nozzles 78 are directed to spray downward toward perforated plate 68 of a vibrating screen deck oriented below a given spray bar 76. Uppermost decks of a vibrating screen typically receive washing fluid from spray bars 76 attached to top side wall angles 54 as shown in FIG. 4, or an outwardly bent flange of the vibrating screen side wall, not shown in FIG. 4.

Limitations on the spacing of decks and position of machine components exist due to location of spray bars 76. Access to areas between decks for servicing is also limited in this prior art design shown in FIG. 4. Stress concentrations between decks around side wall bar holes 52 exist with prior art designs such as shown in FIG. 4. These stresses often cause fractures unless hole reinforcing rings 92 are used. Thus the prior art design shown in FIG. 4 has significant disadvantages. A more complete listing of disadvantages and limitations of this type of spray bar design is found previously in this application.

It should be noted that another common prior art spray bar system exists. This prior art method of employing spray bars is not illustrated in the drawing figures of this application. In this design spray bars are not attached to a vibrating screen body or side walls but are attached to a stationary framework instead. Such a non-moving spray bar design isolates the spray bars from undesirable motion which wears away hoses and stresses spray bars. Stationary spray bar designs do require very large holes in the side walls to prevent the vibrating screen side walls from hitting spray bars while operating. This is especially true during starting and stopping, when a vibrating screen body "jerks" at certain "crossover" frequencies. This is particularly awkward as a design in that it also requires large flanged "skirts", like spray bar hole shields. These large flanged skirts are mounted to spray bars adjacent to the large side wall holes to block the outward flow (loss) of aggregate particles through these large holes. Around such large spray bar holes in side walls, reinforcing rings are much needed to relieve stress concentrations which otherwise would cause fractures in the side wall. A supporting "skeleton" framework holds rows of spray bars at different levels adjacent to machine side walls. These supporting frameworks are expensive to build and make it more difficult to service the vibrating screen. Thus this design also has significant disadvantages/limitations, which are also more completely listed previously in this application.

FIG. 10A—DESCRIPTION OF FLOODED VIBRATING SCREEN DECK SUPPORT STRUCTURE/OPERATION OF FLOODED VIBRATING SCREEN DECK SUPPORT STRUCTURE

Description of Flooded Vibrating Screen Deck Support Structure (FIG. 10A)

Shown in FIG. 10A is a broken, partial, oblique view of a flooded vibrating screen deck support structure of my invention. A "FLOW" vector is shown indicating the feed-to-discharge flow that aggregate particles (not shown in FIG. 10A) would take over a porous deck framework covering (not shown in FIG. 10A). No vibrating screen sidewalls are shown in FIG. 10A. A hollow tubular member identified as a rectangular flooded support tube 30B is shown as a brace/support component of a support tray or deck support framework. Tube 30B has fluid exit holes 34B in a lower discharge facing surface. Tube 30B is attached to deck side framework members identified as modular side angle 20A/continuous side angle 20B which have fluid passage holes small 34A and fastener holes 36. Flat stock pieces oriented essentially with their long axis in the direction of aggregate flow identified as modular support bar 32A/continuous support bar 32B are attached to tube 30B. All members shown in FIG. 10A function as conventional vibrating screen deck framework components but some items are modified to perform additional functions. Hidden lines show the shape of tube 30B in FIG. 10A.

In FIG. 10A rectangular flooded support tube 30B joins with and is essentially normal to modular side angle 20A/continuous side angle 20B. Both angles 20A/20B are shown in FIG. 10A as side perimeter framework members of a deck framework. Modular side angle 20A indicates an embodiment employing support trays, a multiple-pieced deck framework system. Continuous side angle 20B indicates an embodiment employing a continuous framework, a single-piece deck framework system. Side framework angles 20A/20B have fastener holes typical for securing frameworks to vibrating screen sidewalls. A typical fastener hole pattern of the embodiment shown in FIG. 10A flanks or surrounds rectangular flooded support tube 30B and fluid passage hole small 34A. Fluid passage hole small 34A is cut or punched in angles 20A/20B and is centered upon the location of tube 30B. Angles 20A/20B are chosen to withstand both typical deck framework stresses and stresses incurred from pressurized fluids. Angles 20A/20B are shown to be angle in FIG. 10A, but typically any prior art deck framework side member such as channel or flat stock can be modified for use. Typically angles 20A/20B (or other side framework members) are type A36 as found in the prior art and modified to perform the functions described in this application. In some embodiments using higher pressures for fluid distribution, materials of a greater thickness than typically found in the prior art might be used. A variety of materials including, but not limited to, aluminum, stainless steel, alloy metals, Fiberglas, plastics, and composite materials can be used. Fluid passage hole small 34A is shown as circular in shape and is essentially concentric with the longitudinal axis of tube 30B. The shape of fluid passage hole small 34A can vary, but in this embodiment in FIG. 10A, the profile of hole 34A is encompassed by the welded end of tube 30B. The welded/bonded end of tube 30B encompasses hole 34A for fluid sealing purposes. This is a preferred embodiment, but not the only viable embodiment which joins tube 30B and angles 20A/20B and provides fluid containment. The end of tube 30B is joined to side framework members typically by welding or possibly by bonding and, in this embodiment, forms a complete seal around the periphery of tube 30B.

Tube 30B is an internal tubular structural member of a vibrating screen deck framework having fluid exit holes 34B. Tube 30B is typically made of metal having fluid exit holes 34B typically along a leeward portion of the tubular wall. The leeward portion of rectangular flooded support tube 30B is in regard to aggregate flow and is oriented generally in a downward and/or discharge facing direction. Fluid exit holes 34B in tube 30B are threaded in some embodiments and plain in others—fluid exit holes 34B shown in FIG. 10A are plain. Similar to prior art embodiments having tubular supports in a deck framework the long/longitudinal axis of tube 30B is oriented essentially in the horizontal plane and is also oriented crosswise/normal to the flow of aggregate. It should be realized that a variety of crosswise oriented supports are used in the prior art and not only tubular supports are used. Rectangular flooded support tube 30B is attached to side perimeter framework members typically by welding. Tube 30B in the embodiment shown in FIG. 10A is chosen of a sufficient wall thickness, material type and dimensions to function properly in both structural and fluid supply capacities. Typical dimensions and materials used in the prior art for tubular members in deck frameworks are sufficient in many embodiments. Thus thick wall type A36 structural tube can be used, as can metal pipe in various schedules (wall thicknesses). Certain higher pressure embodiments of my flooded deck support structure may require the use of heavier wall thicknesses for rectangular flooded support tube 30B than are typically used in the prior art. Tube 30B is shown as having a square/rectangular cross sectional profile in FIG. 10A but can be any "closed section" tubular member. Fluid passage hole small 34A can be installed in either one or both sides of deck framework side members to supply fluid for tube 30B.

Vibrating screen side walls (not shown in FIG. 10A) also have fluid passage holes to accommodate this embodiment.

Fluid passage holes in side walls are similar to, and aligned with, holes 34A to allow the input of fluids to tube 30B from an external source. Typically vibrating screen side wall fluid passage holes are in alignment with various locations of hole 34A in deck framework side members. An external means of supplying fluid to vibrating screen side wall passage holes is also necessary for operating correctly. This is not illustrated in FIG. 10A but FIGS. 10C and 10D illustrate somewhat further detail of a fluid supply means for my flooded vibrating screen deck support structure shown in FIG. 10A.

Shown in FIG. 11A are both modular support bars 32A, and continuous support bars 32B. Support bars (items 32A/32B) are typically metal and joined to tube 30B and other portions of support tray/deck frameworks by welding. This illustrates the capacity for employing this embodiment in both single pieced and multiple pieced type deck framework systems. This flooded vibrating screen deck system is also compatible with combinations of the single piece/multiple piece designs. This flooded vibrating screen deck support system also successfully replaces other deck framework systems not shown in FIG. 10A that are without support bars such as: perforated plate, polyurethane decking, or other deck framework systems/designs not shown in this application. Typically any deck framework embodiments that can incorporate flooded support tube 30B and its necessary fluid supply means can become an embodiment of my flooded vibrating screen deck support system.

In various prior art deck framework embodiments abrasion resistant (AR) shields are used to protect framework members from wear. Typically in the prior art AR shields are located on the non-leeward side of crosswise oriented structural members. AR shields are not shown anywhere in any drawing figures in this application. A common AR shield embodiment employs a thin metal backing sheet covered by an abrasion resistant rubber material. Some embodiments apply rubber directly to framework members. AR shields are formed to the profile of a framework member and are of sufficient dimensions to protect from aggregate flow. In some prefered embodiments of my improved flooded deck support structure AR shields are employed. In such embodiments tube 30B has AR shields for protection. AR shields are not necessary to function, yet increase service life. This is desirable since rectangular flooded support tube 30B has more functions in my improved flooded deck support structures and thus further justifies the use of AR shields.

Operation of Flooded Vibrating Screen Deck Support Structure (FIG. 10A)

A portion of a flooded vibrating screen deck support structure is shown in FIG. 10A having both an inflow and outflow means for fluid spraying. The deck support structure shown functions in a conventional structural capacity and as a self contained fluid distribution means. Essentially in a structural mode bars 32A/32B support a screening media (not shown in FIG. 10A) and load tube 30B. Tube 30B in turn essentially loads angles 20A/20B. Angles 20A/20B are supported by vibrating screen side walls (not shown in FIG. 10A). This is descriptive of the functioning of components in a simplistic structural sense.

Rectangular flooded support tube 30B and side angles 20A/20B have fluid supply functions in addition to their structural functions. Modular side angle 20A/continuous side angle 20B have fluid passage holes small 34A and fastener holes 36. Fluid passage hole small 34A feeds fluids into tube 30B under pressure. Fastener holes 36 which flank fluid passage hole small 34A serve multiple purposes. Fastener holes 36 in angles 20A/20B support the deck framework, reinforce machine side walls near fluid supply holes, and provide sealing means for fluids in some embodiments such as is shown in FIG. 10C. Tube 30B receives fluid under pressure and, acting as a conduit, supplies fluids to fluid exit holes 34B for spraying. Fluids exiting tube 30B can exit directly through exit holes 34B or indirectly through a spray nozzle or similar device (not shown in FIG. 10A) attached to/aligned with exit hole 34B. Fluid exit holes 34B can be plain or have threads cut into the surface of tube 30B, threaded fittings welded on or fittings pressed into place . . . etc. This is descriptive of the simple functioning of components in a fluid supply capacity.

Fluids for spraying at materials being sorted are supplied by conventional means to the outside of vibrating screen side walls. In the absence of conventional spray bars fluid is supplied directly through vibrating screen side walls (not shown in FIG. 10A) to fluid passage holes small 34A. Vibrating screen side walls have fluid passage holes which are in alignment with fluid passage holes small 34A in angles 20A/20B providing an open fluid passage from outside supply means. Fluid is contained and directed by rectangular flooded support tube 30B which is in alignment with and encircles fluid passage hole small 34A. Fluid exit holes 34B are located in tube 30B along a typically leeward portion (regarding aggregate flow) thereby obtaining protection from particles being sorted. It is not necessary for fluid exit holes 34B to be in a leeward portion of tube 30B though it is a preferred embodiment. Fluids are sprayed at aggregate particles typically moving below fluid exit holes 34B. Tube 30B functions in this sense like conventional spray bars. Typically spray is thus directed at a deck immediately beneath fluid exit holes 34B in one node of operation.

Spray can also be directed upward at the under side of the deck screen media immediately above tube 30B, when desired. The purpose of such an embodiment is to provide a means for clearing blocked screening media and/or the assistance of aggregate movement. The blinding (blockage) of screen media is a costly problem in various screening processes. In some applications the use of fluids sprayed at the underside of screen media to clear blockages via tube 30B is possible. This is possible, in part, due to the close proximity of tube 30B to the screening media mounted immediately above tube 30B. This is in contrast to the spraying of aggregates at a deck immediately below tube 30B which is typically called a washing process. A combination process is possible whereby tube 30B accomplishes both tasks. In one such embodiment alternate flooded support tubes 30B can direct fluids at a deck beneath tube 30B and at the underside of screen media immediately above tube 30B. In this embodiment different fluids such as liquid/air can be used for below/above spraying, in assisting the sorting process.

In one particular embodiment each tube 30B serves both washing and clearing tasks. In such an embodiment a means for directing fluids at a deck beneath tube 30B is present in tube 30B with a means for directing fluids at screen media above tube 30B. Washing typically operates at lower pressures and clearing procedures operate at higher pressures. In such a system self regulated nozzles flow only at pressures below some value "X"—and other self regulated nozzles flow only at some pressure above "X" are attached to each tube 30B. In this embodiment normal washing takes place at pressures below "X" until clearing is needed then fluid pressure in tube 30B is increased to a value above "X" stopping washing spray below tube 30B and starting clearing spray above tube 30B. Nozzles for the purpose of clearing blockages can operate as stationary with direct spray or as moving with a sweeping motion to provide greater coverage. Nozzle flow can also be directed to convey or assist conveyance of particles against or with the established direction of flow of aggregate particles to aid the sorting process in particular applications.

AR shields (not shown in FIG. 10A) are often used in the prior art to protect crosswise oriented structural members in vibrating screen decks. AR shields, though not shown in FIG. 10A, are an ideal compliment to tube 30B as protection from abrasion. Tube 30B functions typically as both a structural member of a deck framework and as a means for spraying aggregate and is thus more important as a deck element. The use of AR shields are thus more justified than previous applications in the prior art and is a preferred embodiment in my flooded vibrating screen deck support structure.

Support trays containing tube 30B and angles 20A/20B function ideally as part of a multiple pieced deck framework system. As sub-deck assembly units wear out, sections are replaced as needed, similar to the prior art. As flooded support tray structures serve multiple roles and are a more important assembly their selective replacement is a valuable feature of a multiple pieced deck framework system.

The term fluids used here embraces liquids and gases and here should be understood to also include mists and vapors or solutions having suspended particles or particles carried by a fluid vehicle. In any applications for recycling or production sorting, solvents or chemical compounds to remove coatings can be used as well as "blasting" with particles suspended in/carried by a fluid to remove coatings. The application of coatings/sealers for items being conveyed/sorted in a vibrating screen or similar device is also possible with this flooded vibrating screen deck support structure.

The term aggregates embraces all types of materials that can be sorted in vibrating screens. This includes concrete products, stone, gravel, sand, food particles, recycling materials, construction debris . . . etc.

The embodiment shown in FIG. 10A also contains intrinsically the capability of spraying fluids at materials being conveyed below the lowest deck in a vibrating screen. This is possible since support trays having tube 30B as shown in FIG. 10A are able to spray fluids at areas below the deck in which they are contained. This capability is not intrinsic to spray bar systems which must provide another means of support/deployment for spray bars below the lowest deck when such spraying is desired.

From the description and operation of my flooded vibrating screen deck support structure revealed here, a number of advantages become evident:

(a) Vibrating screens employing my flooded deck support structure can be configured with more (closer spaced) deck layers and/or more compact machine sizing in height. This is due to the open space between decks my flooded deck support structure provides, as compared to the prior art.

(b) Side walls of vibrating screens employing my flooded deck support structure require smaller fluid supply hole cutouts, and thus require less time, energy, and tooling to manufacture than prior art spray bar holes.

(c) Side wall fluid supply hole locations in vibrating screens employing my flooded deck support structure are located where reinforcement is obtained from deck support structures, and therefore are stronger. This is also in part due to the ability to flank or surround the holes in side walls with fasteners securing deck structures.

(d) In vibrating screens employing my flooded deck support structure no side wall hole shields or hole skirts are needed. These parts are used to cover open areas between spray bars and the edges of side wall spray bar holes. Such open areas are eliminated intrinsically by the locations of fluid supply holes and related parts used in my flooded deck support structure.

(e) The need for side wall hole reinforcing rings around spray bar holes in side walls is not present in my flooded deck support structure. This is due to the different size, location, and purpose of the fluid supply holes employed in my flooded deck support structure.

(f) No angle brackets are needed at side wall spray bar hole locations in my flooded deck support structure, since no spray bars are used.

(g) No spray bar mounting "U" bolts or other bracket securing fasteners/means are needed in my flooded deck support structure, since no spray bars are used.

(h) No spray bar reinforcer/stiffener is needed in my flooded deck support structure, since spray bars are not used.

(i) No aggregate shields for spray bars are needed in my flooded deck support structure, since spray bars are not used.

(j) No spray bar center braces are needed in my flooded deck support structure, since spray bars are not used.

(k) No spray bar support frameworks are needed in my flooded deck support structure, since spray bars are not used.

(l) For some specialized applications requiring clearing of blocked screening media, the availability is present in my flooded deck support structure for spraying close to the underside of screening media for clearing and/or conveying some types of materials.

(m) A provision for spraying fluids below and at the underside of the lowest deck is present intrinsically in a vibrating screen employing my flooded deck support structure.

It should be realized that the above listing is not necessarily all the advantages of my flooded deck support structure over the prior art. It should be further realized that a few of the above advantages over the prior art are specific to either moving or stationary spray bar designs. However the advantages of my flooded deck support structure over either type of embodiment in the prior art are numerous and substantial.

FIG. 10B—DESCRIPTION OF FLOODED VIBRATING SCREEN STRUCTURAL SUPPORT/OPERATION OF FLOODED VIBRATING SCREEN STRUCTURAL SUPPORT

Description of Flooded Vibrating Screen Structural Support (FIG. 10B)

Shown in FIG. 10B is a partial, broken, oblique view of a flooded vibrating screen structural support having fluid spraying capabilities. Typically this component is installed above the uppermost deck in a vibrating screen, above aggregate flow. A FLOW vector shown in FIG. 10B indicates the general direction of flow that aggregate particles would take over a deck surface in a typical vibrating screen relative to the parts shown. No aggregate particles, deck components, side walls or other vibrating screen parts are shown in FIG. 10B. The shape of tube 30A is shown by hidden lines.

Shown in FIG. 10B is a round flooded support tube 30A, typically metal, having fluid exit holes 34B along a typically downward and/or discharge facing surface of tube 30A. Fluid exit holes 34B in tube 30A are shown plain in FIG. 10B. Also shown in FIG. 10B is a flat end plate 110, typically metal, which is attached to tube 30A, having fastener holes 36 and a fluid passage hole small 34A. A complete flooded vibrating screen structural support of the type shown in FIG. 10B, in one of its simplest embodiments, has one round flooded support tube 30A and two flat end plates 110. Flat end plate 110 is oriented essentially normal to the longitudinal axis of tube 30A and is joined to tube 30A typically by welding or bonding. Fluid passage hole small 34A in plate 110 is shown in FIG. 10B essentially encompassed by tube 30A. Fastener holes 36 in plate 110 essentially flank or surround fluid passage hole small 34A in plate 110. The homogeneous welds/bonding methods joining tube 30A and plate 110 in the embodiment shown in FIG. 10B provide a fluid tight seal.

Both round flooded support tube 30A and flat end plate 110 are chosen of dimensions and material type to withstand the combined stresses of both structural and fluid supply functions. In most embodiments plate 110 and tube 30A are of typical dimensions found in the prior art for tubular type brace components. In some high pressure applications plate 110 might have a greater than typical thickness, and/or tube 30A might be chosen of a greater than typical wall thickness/dimensions. No nozzles or spray deflectors for spraying are shown in FIG. 10B for illustrative purposes. Nozzles or spray deflectors are not necessary for spraying, but are used in many preferred embodiments. Accordingly, in some embodiments, fluid exit hole 34B has threads and/or welded on threaded fittings to accommodate various types of fluid spraying nozzles.

Operation of Flooded Vibrating Screen Structural Support (FIG. 10B)

The flooded structural support shown in FIG. 10B has basically two functions. One function is structurally supporting the other is fluid spraying. In the prior art braces located above a top deck in a vibrating screen are now rarely employed as structural members. In the prior art spray bars are often located above an uppermost deck in vibrating screens employing fluid spraying means. The flooded vibrating screen structural support shown in FIG. 10B replaces prior art top deck spray bars and acts as a top side wall brace in machines employing a fluid spraying means.

Fasteners (not shown in FIG. 10B) of a size typically employed in the prior art for brace components secure flat end plates 110 to vibrating screen side walls (not shown in FIG. 10B). Both side walls and flat end plate 110 have fastener holes 36 for this purpose. Inward, outward, and twisting forces between side walls are thus resisted by this flooded structural support. Side walls have a fluid passage hole essentially concentric with fluid passage hole small 34A in plate 110. Side wall fluid passage holes are typically slightly larger than hole 34A. This provides fluid supply access to hole 34A in plate 110. Fluid passage hole small 34A is shown plain in FIG. 10B but can have threads in other embodiments to receive a pipe nipple or similar fluid supply member.

Operating as a brace component the flooded structural support resists inward and outward forces on sidewalls as well as twisting forces which cause "racking" of vibrating screens. Operating as a fluid supply member my flooded structural support in FIG. 10B supplies fluid spray to an upper deck of a vibrating screen. Tubular components are preferred for their ability to resist twisting forces between side walls of vibrating screens. The flooded structural support shown in FIG. 10B is ideal in this capacity. Prior art spray bars typically are not suited for such structural duties, as their means of attachment precludes effective resistance of inward, outward, and twisting forces that are substantial. Most vibrating screens operate effectively without braces above their uppermost deck, vibrating screen designs having evolved in this direction. However screens requiring a fluid spraying means for an uppermost deck benefit from the structural performance of my flooded structural support. This is true particularly to prevent racking, and to prevent excessive side wall deflection during machine operation and lifting operations during moving/installation.

Shown in FIG. 10B is an embodiment of my flooded structural support employing flat end plates 110. It should be realized that essentially the same results are obtained if other than rectangular shaped plates are used. This is provided that both fastener holes 36, and fluid passage hole small 34A, are located essentially in similar locations relative to each other and round flooded support tube 30A. It should be further realized that sections of channel or angle or other similar structural members having a web or leg suitable to perform in the capacity of flat end plate 110 could be used instead of plate 110. In the case of channel the legs would point inward toward the center of the machine providing a flat planar portion to contact and mount to vibrating screen side walls. In the case of angular members legs could also point outward provided the outward pointing leg is located beyond the edge of the machine side wall. A continuous flat strip of steel instead of plate 110 could be used, making a "ladder" type structure connecting multiple flooded support tubes 30A. This is true for angle or channel or other structural lengths that could replace plate 110, operating in some ways similar to my flooded deck support structure shown in FIG. 10A. Round flooded support tube 30A in FIG. 10B could be any "closed section" tubular member having the necessary strength requirements in both structural and fluid supply capacities. Square, rectangular, oval . . . etc. can be used. A preferred embodiment employs thick wall structural tube known as "A36" or "extra heavy" wall pipe. Both are easily obtained and fabricated. Other more specialized machines can employ stainless, aluminum, Fiberglas, certain plastics, composite materials . . . etc.

FIG. 10C—DESCRIPTION OF FLANGED PIPE STUB INPUT/OPERATION OF FLANGED PIPE STUB INPUT

Description of Flanged Pipe Stub Input (FIG. 10C)

Shown in FIG. 10C is a partial, broken, end view with some cross sectional detail of one means of fluid supply for my flooded vibrating screen deck support structures shown in FIGS. 10A and 10B. Typically all parts are metal except item 94 which is flexible and typically some type of rubber compound. For illustrative purposes three basic part groups are separated by some distance as if not assembled. The basic part groups are joined together when assembled typically by fasteners or some mechanical fastening means to become part of a vibrating screen. The left group has items 98 and 96 and is a fluid input means. The central group has items 50 and 94 and is a vibrating screen side wall with sealing means. The right group has items 20A/20B, 30A/30B and 22 and is a flooded deck support structure like that shown in FIG. 10A. For clarity not all details are shown—welds, fasteners, fastener holes, coatings, fluids, etc. are left out of FIG. 10C. A center projection line shows alignment of parts in FIG. 10C.

Shown on the right hand side of FIG. 10C, in the right group, is a support tray or continuous type deck framework structure having flooded internal support tube 30A/30B. Item 30A/30B is employed as both a structural component and as a fluid distribution means. Attached to item 30/30B is side framework member 20A/20B having fluid input hole 34A partially shown in cross section in a broken out portion. Side framework members 20A/20B have fastener holes around fluid input hole 34A of a size and pattern essentially identical to those in side wall 50 and flange plate 96, but no fastener holes are shown in FIG. 10C for simplicity of illustration. A typical fastener hole pattern of this type is shown in FIGS. 10A and 10B in side angle 20A/20B and flat end plate 110, respectively. FIG. 10A shows a similar (or possibly identical) embodiment to that of the right hand group of FIG. 10C and comprises side angle 20A/20B and rectangular flooded support tube 30B. Both angle 20A/20B and tube 30B are previously discussed in greater detail in text pertaining to FIG. 10A.

Spaced some distance to the left of items 30A/30B, 20A/20B and 22, and central to FIG. 10C are items 50 and 94. Item 50 is a vibrating screen (or similar device) side wall. Item 50 has a hole identified as fluid passage hole large 108 partially shown in cross section in a broken out portion which encircles O ring 94. Item 94 is an O ring. O ring 94 has a "relaxed" thickness which exceeds the cross sectional thickness of side wall 50. O ring 94 has an inside diameter/size essentially equal to or greater than fluid input hole 34A and an outside diameter/size essentially equal to or less than fluid passage hole large 108 in side wall 50. The size of hole 108 and hole 34A diameters are sized to accommodate the thickness of O ring 94 and other fluid supply and sealing requirements. Side wall 50 has fastener holes (not shown in FIG. 10C) around fluid passage hole large 108 of a size and pattern identical to flange plate 96 and side framework members 20A/20B. Fluid passage hole large 108 in side wall 50 containing O ring 94 is typically also less in diameter than the planar dimensions of items 96 and 20A/20B where they contact item 50. Items 50 and 94 are not necessarily bonded/attached to each other. When assembled items 20A/20B would be against items 50 and 94, compressing O ring 94 to be in plane with the inside (and outside) surfaces of side wall 50.

Spaced some distance to the left of items 50 and 94 are items 98 and 96. Shown in the left portion of FIG. 10C making up the left group is pipe stub 98 and flange plate 96. FIG. 10C shows an end view of the left group with a partially broken away section of items 96 and 98 revealing fluid passage hole small 34A in flange plate 96. Fluid passage hole small 34A is shown in both flange plate 96 and side angle 20A/20B and is essentially the same in diameter/size/shape in both pieces. Items 98 and 96 are joined typically by welding and thus act as a unified, sealed unit for fluid containment capabilities. Flange plate 96 has a fluid input hole 34A essentially the same size and profile as that in side angle 20A/20B and is in alignment with the inside diameter of pipe stub 98. Pipe stub 98 has an open tube end 38 opposite flange plate 96. Flange plate 96 has fastener holes of an identical size and pattern around fluid input hole 34A as side wall 50 and side angle 20A/20B, though no fastener holes are shown for clarity in this view of FIG. 10C. Fluid input hole 34A in flange plate 96 is essentially concentric with fluid passage hole large 108 in side wall 50 when assembled. When installed plate 96 is against side wall 50 and O ring 94, compressing O ring 94 to be in plane with the outside (and inside) surface of side wall 50.

When completely assembled flange plate 96 is fastened against side wall 50 and O ring 94. Side angle 20A/20B is also fastened against side wall 50 and O ring 94. Fluid passage hole small 34A, fluid passage hole large 108 and O ring 94 are essentially concentric to the same axis. O ring 94 is essentially free to "float" within fluid passage hole large 108 in side wall 50 but is squeezed between, and seals against, flange plate 96 and side angle 20A/20B. The net effect of the three aligned and assembled part groups is a sealed fluid passageway from the outside to the inside of a vibrating screen or other process machine. It should be apparent to the reader that various hole shapes for fluid passage hole small 34A and fluid passage hole large 108 are possible for successful fluid sealing purposes. It should be further realized that O ring 94 can be eliminated by the use of gaskets and/or sealing compounds such as silicone type sealants.

Operation of Flanged Pipe Stub Input (FIG. 10C)

Fluid input for distribution through flooded support tube 30A/30B is accomplished by supplying fluid under pressure to pipe stub 98. Typically fluid is supplied by some type of manifold having flexible hose attached to open tube end 38 of pipe stub 98. In FIG. 10C the flow of fluids moves generally in a left to right direction across the drawing page—though no FLOW vectors are shown for either fluids or for aggregates being sorted. Aggregates would flow either to or away from the observer of FIG. 10C, essentially normal to the plane of the page, though neither fluids nor aggregate particles are shown in FIG. 10C. Fluids thus enter open tube end 38, pass through pipe stub 98, pass through fluid passage hole small 34A in flange plate 96, pass through O ring 94, pass through fluid input hole small 34A in side angle 20A/20B and enter flooded support tube 30A/30B. Fluid making its way into flooded internal support tube 30B is then distributed as per the methods described in text for FIGS. 10A/10B. Fasteners joining flange plate 96, side wall 50 and side angle 20A/20B around the periphery of fluid input holes mount components and seal fluids in. Surrounding the fluid passage way openings with fasteners like flanged pipe fittings helps in sealing and is strong structurally. In particular the fastener pattern surrounding fluid passage hole large 108 in side wall 50 reinforces this portion of side wall 50. This is especially true when both items 96 and 20A/20B "sandwich" side wall 50 around the fluid passage hole area in side wall 50. The pattern shown in FIG. 10A is thus preferred but any pattern satisfying both sealing and mounting requirements of the components shown in FIG. 10C will do.

Sealing is accomplished by O ring 94 which is compressed between flange plate 96 and side angle 20A/20B. This is a simple, reliable method, usually not very sensitive to slight inconsistencies in materials. Many other methods for sealing exist and include many combinations of gaskets and/or sealing compounds and/or gasket forming compounds such as silicone. Thus many viable options are available for sealing purposes. The shape of fluid input holes 34A as shown in 10A particularly show a round hole—perfectly round holes are not a passage way requirement either—just one preferred embodiment. Pipe stub 98 is shown as essentially normal/perpendicular to flange plate 96, but this is not necessarily a requirement.

FIG. 10D—DESCRIPTION OF THREADED PIPE STUB INPUT/OPERATION OF THREADED PIPE STUB INPUT

Description of Threaded Pipe Stub Input

Shown in FIG. 10D is a partial, broken, end view of one method of fluid supply means for my flooded vibrating screen deck support structure as shown in FIG. 10A and my flooded vibrating screen support structure shown in FIG. 10B. No flow vectors for either aggregate or for fluid movement are shown in FIG. 10D. The typical flow of fluid in FIG. 10D is from left to right as a means for supplying flooded support tube 30A/30B. No fluid is shown however in FIG. 10D. The flow of aggregate would be either to or away from the observer essentially normal to the plain of the page. No aggregate particles are shown however in FIG. 10D. Typically all parts shown are metal of some kind but can be other materials suitable for structural applications in vibrating screens or similar devices. Three basic part groups are shown in FIG. 10D separated by some distance for clarity. Not all details are shown such as surrounding components, welds, fasteners/fastener holes etc. for illustrative purposes. A threaded pipe nipple 100 is shown in the left hand group. A (vibrating screen) side wall 50 with a fluid passage hole large 108 is shown as a center part group. A support tray or continuous type deck support framework similar to that shown in FIGS. 10A and 10C is shown as a right hand group having side angle 20A/20B flooded internal support tube 30A/30B and framework end member 22. A center projection line shows a concentric alignment of fluid supply hole centers about a common axis for assembly.

The left hand side group in FIG. 10D has threaded pipe nipple 100 having threads—typically national pipe standard (U.S.). However any standard shared by both pipe nipple 100 and threaded input hole 102 in side angle 20A/20B will work. FIG. 10D shows female threads in threaded input hole 102 but an alternate embodiment for threads cut into side angle 20A/20B is a welded fitting on the inside surface of side angle 20A/20B. In some embodiments both ends of pipe nipple 100 are threaded though only one end is shown threaded in FIG. 10D. Wall thicknesses and material dimensions and type vary per application but a typical embodiment is standard wall, black pipe.

The center group in FIG. 10D has a side wall 50 having fluid passage hole large 108. Fluid passage hole large 108 shown in cross section in side wall 50 is not very critical in shape or size except that it exceeds the outside diameter of pipe nipple 100. However it is a preferred embodiment to have fluid passage hole large 108 in side wall 50 be closely sized with the outside of pipe nipple 100 for strength/structural integrity reasons.

The right hand group in FIG. 10D is a support tray or continuous type deck framework support system such as that shown in FIG. 10A having at least one flooded internal support tube 30A/30B. This is typical for side angle 20A/20B, flooded support tube 30A/30B and framework end member 22 shown previously in both FIGS. 10A and 10C with one addition/change. Threaded input hole 102 in FIG. 10D replaces fluid passage hole small 34A in FIGS. 10A and 10C. National pipe threads shown in FIG. 10D are cut into side side angle 20A/20B. An alternate embodiment similar to that shown in FIG. 10D (but not shown in FIGS. in this application) has a threaded fitting attached to side angle 20A/20B. No threaded fitting is shown in FIG. 10D but the general location of such a fitting is typically inside flooded support tube 30A/30B concentric with the axis/center of threaded input hole 102 in FIG. 10D. Threads identified by threaded input hole 102 are of the same size as threaded pipe nipple 100 for mated assembly.

When all part groups are assembled threaded pipe nipple 100 is threaded into fluid input hole 102 to accomplish a fluid tight seal. Thread sealing compounds are used as needed in higher pressure applications. When assembled side angle 20A/20B is against side wall 50. Fastener holes are not shown in either side angle 20A/20B or side wall 50 in FIG. 10D but a typical pattern for fasteners in the area near fluid input hole 108 and threaded input hole 102 is shown in FIG. 10A or 10B. A typical preferred fastener hole pattern for assembly of side wall 50 to side angle 20A/20B is one that surrounds the fluid passage hole in side wall 50. This provides reinforcement for side wall 50 at/near the fluid passage hole thereby reducing the chance of stress related cracking.

Operation of Threaded Pipe Stub Input

When assembled and operational fluid is supplied under pressure to threaded pipe nipple 100. This is done typically by a supply manifold having outlets fitted with flexible hose—neither of which is shown in FIG. 10D. Flexible hose fits over threaded pipe nipple 100 at open tube end 38 and is held in place and sealed typically by hose clamps—also not shown in FIG. 10D. Fluid reaching open tube end 38 is then directed inside pipe nipple 100, past side wall 50, past side angle 20A/20B and directly into flooded internal support tube 30B. Fluid is then distributed within a vibrating screen or similar device by flooded support tube 30A/30B.

Many variations of the embodiments shown in FIG. 10C and 10D are possible. FIGS. 10C and 10D illustrate two preferred embodiments of many possible fluid supply means for my flooded vibrating screen support structures shown in FIGS. 10A and 10B. Both embodiments compliment well the flooded vibrating screen deck support structure shown in FIG. 10A and the flooded vibrating screen support structure shown in 10B. Both of the embodiments shown in FIGS. 10C and 10D, as part of a fluid supply means for my flooded vibrating screen support structures shown in FIGS. 10A and 10B are simpler and inherently stronger than fluid spraying systems found in the prior art. The embodiment shown in FIG. 10C reinforces significantly side wall 50 with (external) flange plate 96. Both of the fluid supply means illustrated in FIGS. 10C and 10D capitalize upon the need/usage of existing prior art fastener locations for support trays/deck support frameworks. Fastener locations for my flooded support tray/deck support frameworks will probably vary from some embodiments in the prior art in that fasteners will be possibly more closely located about my flooded support tube 30A/30B than the prior art's crosswise oriented framework support members. The number of fasteners for my flooded support trays/deck support frameworks is otherwise similar to the prior art, possibly more fasteners than the prior art would be used in some applications. The embodiment shown in FIG. 10D is also strong, providing reinforcement for side wall 50 on either side/around fluid passage hole large 108 with fasteners oriented in a pattern typical to that shown in FIGS. 10A and 10B.

FIG. 10E—INSTALLED FLOODED VIBRATING SCREEN DECK SUPPORT STRUCTURE

Shown in FIG. 10E is a broken, partial, oblique view of a flooded vibrating screen deck support structure of my invention. FIG. 10E illustrates a portion of a vibrating screen having two side walls which flank my flooded deck support structure shown installed within. A "FLOW" vector identifies the general direction of flow for aggregate or sorting material that would flow over my flooded deck support structure during operation. Some components of an operational vibrating screen in the area shown are not present in FIG. 10E for illustrative purposes. The flooded deck support structure shown in FIG. 10E is also illustrated in FIG. 10A. FIG. 10A shows greater detail and has hidden lines showing the shape of components. The embodiment of my flooded deck support structure shown in FIGS. 10A and 10E is able to receive fluid for spraying by a supply means such as is shown in FIG. 10C.

FIG. 10F—INSTALLED FLOODED VIBRATING SCREEN STRUCTURAL SUPPORT

Shown in FIG. 10F is a broken, partial, oblique view of a flooded vibrating screen structural support of my invention. FIG. 10F illustrates a top side wall portion of a vibrating screen having my flooded structural support installed within. A "FLOW" vector shows the general direction of aggregate or sorting material that would flow beneath my flooded structure when operating. Some components necessary for proper operation such as fasteners and fluid supply means are not shown in FIG. 10F for illustrative purposes. The flooded structural support shown in FIG. 10F is also illustrated in FIG. 10B. FIG. 10B shows greater detail and has hidden lines showing the shape of round flooded support tube 30A. The embodiment shown in FIGS. 10B and 10F is able to receive fluid for spraying by a supply means such as is shown in FIG. 10C.

SUMMARY, RAMIFICATIONS, AND SCOPE

Accordingly the reader will see that the flooded vibrating screen support structure and the flooded vibrating screen support tray/deck framework support of my invention have many significant improvements over the prior art in both manufacture and operation. These advantages vary with the embodiment considered over the prior art. Some advantages over the prior art of my flooded vibrating screen support structures shown in FIGS. 10A to 10F are:

vibrating screen decks can be spaced closer together and/or more decks can be installed for a given machine (compared to prior art live and especially stationary designs)

smaller holes are required for fluid input purposes in vibrating screen side walls (compared to prior art live and especially stationary designs)

location of fluid input holes in side wall is stronger—being flanked/surrounded by fasteners (compared to prior art live and especially stationary designs)

no need for side wall hole shields/skirts since no gaps have to sealed in side wall holes as around prior art spray bars (compared to prior art live and especially stationary designs)

no need for prior art side wall hole reinforcing rings since side wall holes for my flooded deck support structures are smaller and are located at a structurally supporting component with adjacent/surrounding fasteners (compared to prior art live and especially stationary designs)

no need for angle brackets at side walls since spray bars are eliminated (compared to prior art live designs)

no need for "U" bolts to mount spray bars as spray bars are eliminated (compared to both prior art stationary and live designs)

no need for prior art spray bar angle reinforcer/protector—provided inherently in deck structural protection (compared to prior art stationary and especially live designs)

no need for spray bar center brace as spray bars are eliminated between decks (compared to prior art live designs)

no need for spray bars between decks, integrated within deck framework structure (compared to prior art live and stationary designs)

no need for spray bar support frameworks to hold spray bars in place (compared to some prior art live (top/uppermost deck) but particularly stationary designs)

inherent provision for spraying below lowest deck is present in my flooded support tray/deck support framework system when desired (on conveyers, troughs . . . etc.) (compared with both prior art stationary and live designs)

optional under cloth clearing/assist of sorting in certain applications is possible with my flooded support structures due to the close proximity of fluid exit holes to screening media (compared with both prior art stationary and live designs)

It should be realized that these advantages are comparisons with various prior art embodiments and thus the advantages vary somewhat depending upon the particular embodiments compared. It should be realized that the embodiments shown are not all possible embodiments just some of the presently preferred embodiments. It should thus further be realized that these advantages listed are not necessarily all of the advantages of my improved flooded vibrating screen support structures. Although many specifics concerning the above embodiments have been mentioned in this application these should in no way be construed as limiting the scope of this invention. Many variations in materials, dimensions, locations of holes, spacing of components etc. can be employed successfully. Some of the variations have been mentioned in text pertaining to each of the drawing FIGS.

For example in FIG. 10B flat end plate 110 can be replaced with a flat plate of almost any planar shape. These alternate plates having fluid passage hole small 34A and fastener holes 36 in combination with round flooded support tube 30A become a structural component providing both support and fluid distribution means for portions above an uppermost deck. This same structural support shown in FIG. 10B or a similar embodiment thereof can be employed as a replacement for tubular braces that are often employed as structural supports in the prior art. Tubular braces are typically used between decks immediately below a deck's support trays or deck support framework. Further to FIG. 10B other structural members can be used in place of a flat plate such as angle or channel as mentioned previously in text relating to FIG. 10B. In addition the structural members used in place of plate 110 in FIG. 10B can be elongated such as continuous side angle 20B shown in FIG. 10A. Thus two opposed members such as continuous side angle 20B would have multiple fluid passage holes small 34A and accordingly multiple flooded support tubes 30A/30B essentially concentric to holes 34A. This makes for a "ladder" shaped structure similar to my flooded deck support framework shown/described in FIG. 10A except that this "ladder" shaped structure would not (in this embodiment) support screening media directly.

For fluid supply purposes fluid passage hole small 34, fluid passage hole large 108 and O ring 94 can be configured in oval, square, rectangular, triangular . . . etc. shapes and-accomplish both fluid supply and structural tasks. Likewise flooded support tubes 30A/30B can be of various cross sectional profiles—oval, square, rectangular, triangular . . . etc. The orientation of flooded support tube 30A/30B is shown as being essentially normal/perpendicular to flat end plate side angle 20A/20B and side wall 50 but this isn't a requirement for operation. Vibrating screens with tapered side walls and/or flooded support tubes 30A/30B that have an angled or "skewed" orientation are possible. Many other possible embodiments within the scope of this invention occur with changes in framework components to adapt to various screening media—many types of which are not shown in this application.

Shown in this application in FIGS. 10C and 10D are two of many possible fluid supply methods/means possible for my vibrating screen flooded support structures shown in FIGS. 10A—10F. It should be realized that tapered "friction fit" tubular members can be inserted (driven) into flooded support tube 30A/30B and/or hole 34A accomplishing both sealing and retaining functions. It should also be realized that tubular members of a profile/diameter smaller than, and inserted into, flooded support tube 30A/30B and/or hole 34A can be combined with an epoxy or silicone (or other) type sealer which can retain and seal such "smaller" inserted tubular members. It should also be realized that "smaller" tubular members having "O" rings in a groove or grooves can be inserted within flooded support tube 30A/30B and or hole 34A for a fluid supply means. It should be also realized that "smaller" tubular members can be inserted within flooded support tube 30A/30B and/or hole 34A which have a "shrink groove" which retains and by mechanical means compresses via a sleeve (or other device) an "O" ring or elastomer causing such an "O" ring or elastomer to expand outward from such a "smaller" tubular member and thus to "squeeze" against the inner wall of flooded support tube 30A/30B and/or hole 34A. Thus the methods/means of fluid supply mentioned here and/or illustrated earlier in this application are not a comprehensive listing of all possible fluid supply methods/means, just some of the preferred methods/means.

Also of particular note is an application of my flooded deck support structure when installed within vibrating screens which have deck support structures which move independent of the side walls. In these types of machines the support trays or deck support framework is accelerated independent of the (essentially stationary) vibrating screen side walls for an energy savings. In these types of applications where my flooded support tray/deck support framework is used side walls would have an enlarged and/or slotted fluid passage hole in place of fluid passage hole large 108 (FIGS. 10C–10F). A fluid supply means such as is shown in FIG. 10D can then be employed in which the fluid supply means is mounted directly to and sealed within side framework members. The possibility of mounting my flooded vibrating screen structural support such as is shown in FIG. 10B directly to side walls, beneath a deck as a support brace is possible also, providing both structural support of side walls and fluid spraying functions. This can also be accomplished in this type of application by a "ladder" type embodiment having two side members with multiple flooded support tubes.

Thus the scope of this invention should be determined by the appended claims and their legal equivalents, rather than by the examples given.

I claim:

1. For use within a vibrating screen or similar device, said vibrating screen or similar device having two or more side wall or similar portions thereof, said two or more side wall or similar portions having one or more holes or slots or passageways therein, a structurally supporting component comprising:

(a) an elongated tubular member having a predetermined wall thickness and a predetermined length and a predetermined cross sectional shape about a longitudinal axis and two opposed open end portions and one or more outlet ports in the wall thereof, and (b) two end members having predetermined dimensions and at least one essentially planar surface on each of said two end members and at least one hole located in at least one of said two end members, said hole passing through said essentially planar surface in a predetermined location, and (c) joining means attaching said two end members in an essentially permanent manner to said elongated tubular member at or near said two opposed open end portions of said elongated tubular member and at or near said essentially planar surfaces of said two end members, said elongated tubular member essentially aligned with and/or essentially concentric with at least one of said holes in at least one of said two end members, and (d) fastening means enabling said essentially planar surface of each of said two end members to join with and become connected within said vibrating screen or similar device to said side wall or similar portions, said two end members located principally between said side wall or similar portions of said vibrating screen or similar device, said longitudinal axis of said elongated tubular member oriented to point toward said side wall or similar portions, said elongated tubular member or a tubular extension of said elongated tubular member passing through and/or essentially aligned with said holes or slots or passageways in said side wall or similar portions, said elongated tubular member and/or said tubular extension of said elongated tubular member extending to areas outside said vibrating screen or similar device, and (e) fluid supplying means including a fluid supply and tubular conduit and including one or more of said holes or slots or passageways in said side wall or similar portions which enable connection of said structurally supporting component to said fluid supply, to convey fluids or fluid like substances from said fluid supply for distribution essentially within said vibrating screen or similar device, whereby said structurally supporting component provides fluid distribution in addition to structural rigidity and/or support for said vibrating screen or similar device.

2. The structurally supporting component of claim 1 wherein said elongated tubular member and said two end members are made of metal.

3. The component of claim 2 wherein said joining means attaching said two end members in an essentially permanent manner to said elongated tubular member is welding or brazing or soldering or forced resistance fit.

4. The structurally supporting component of claim 1 wherein said fastening means enabling said two end members to join with and become connected to said vibrating screen or similar device at or near said side wall or similar portions includes fastener holes in said two end members and in said side wall or similar portions, and mechanical fasteners which pass through said fastener holes and attach said two end members to said side wall or similar portions in a secure manner.

5. The structurally supporting component of claim 1 wherein said elongated tubular member and/or said tubular extension and/or said two end members are made of material selected from the group consisting of plastics and glass fiber reinforced substances and carbon fiber reinforced substances and aramid fiber reinforced substances and ceramic substances and metallic ceramic substances and rubber substances and reinforced rubber substances and rubber composite substances.

6. The structurally supporting component of claim 1 wherein said fluid supply and tubular conduit includes a flanged tubular member, said flanged tubular member having a tubular portion and an essentially planar surface portion, whereby said essentially planar surface portion is attached to either of said side wall or similar portions and/or either of said two end members, and is essentially aligned with any of said holes or slots or passageways in either of said side wall or similar portions and/or is essentially aligned with either of said two opposed open end portions of said elongated tubular member, whereby said flanged tubular member conveys said fluids and/or fluid like substances to said structurally supporting component, and whereby a removable extension of said structurally supporting component providing reinforcement at or near the mounting location of said flanged tubular member for either or both of said side wall or similar portions and/or for either or both of said two end members is obtained.

7. The structurally supporting component of claim 1 wherein said fluid supply and tubular conduit includes a threaded tubular member and mated receiving threads, said mated receiving threads essentially located in or near said holes or slots or passageways in either of said side wall or similar portions and/or essentially located in or near either or both of said two end members and/or essentially located in or near either of said two opposed open end portions of said elongated tubular member, whereby said threaded tubular member is a removable extension of said structurally supporting component facilitating the supply of said fluids or fluid like substances and also facilitating the easier removal and/or installation of said structurally supporting component of said vibrating screen or similar device.

8. For use within a vibrating screen or similar device, said vibrating screen or similar device having two or more side wall or similar portions thereof, said two or more side wall or similar portions having one or more holes or slots or passageways therein, a support tray or deck support framework or similar component comprising:

(a) one or more elongated tubular members having a predetermined wall thickness and a predetermined length and a predetermined cross sectional shape about a longitudinal axis and two opposed open end portions and one or more outlet ports in the wall thereof, and (b) two end members having predetermined dimensions and at least one essentially planar surface on each of said two end members and at least one hole located in at least one of said two end members, said hole passing through said essentially planar surface in a predetermined location, and (c) joining means attaching said two end members in an essentially permanent manner to said one or more elongated tubular members at or near said two opposed open end portions of said elongated tubular members and at or near said essentially planar surfaces of said two end members, each of said one or more elongated tubular members essentially aligned with and/or essentially concentric with at least one of said holes in at least one of said two end members, and (d) fastening means enabling said essentially planar surface of each of said two end members to join with and become connected within said vibrating screen or similar device to said side wall or similar portions, said two end members located principally between said side wall or similar portions of said vibrating screen or similar device, said longitudinal axis of said one or more elongated tubular members oriented to point toward said side wall or similar portions, said one or more elongated tubular members or one or more tubular extensions of said one or more elongated tubular members passing through and/or essentially aligned with said holes or slots or passageways in said side wall or similar portions, said one or more elongated tubular members and/or said one or more tubular extensions of said one or more elongated tubular members extending to areas outside said vibrating screen or similar device, and (e) fluid supplying means including a fluid supply and tubular conduit and including one or more of said holes or slots or passageways in said side wall or similar portions which enable connection of said support tray or deck support framework or similar component to said fluid supply, to convey fluids or fluid like substances from said fluid supply for distribution essentially within said vibrating screen or similar device, whereby said support tray or deck support framework or similar component provides fluid distribution in addition to structural rigidity and/or support as part of a vibrating screen deck in said vibrating screen or similar device.

9. The support tray or deck support framework or similar component of claim 8 wherein said one or more elongated tubular members and said two end members are made of metal.

10. The support tray or deck support framework or similar component of claim 9 wherein said joining means attaching said two end members in an essentially permanent manner to said one or more elongated tubular members is welding or brazing or soldering or forced resistance fit.

11. The support tray or deck support framework or similar component of claim 8 wherein said fastening means enabling said two end members to join with and become connected to said vibrating screen or similar device at or near said side wall or similar portions includes fastener holes in said two end members and in said side wall or similar portions, and mechanical fasteners which pass through said fastener holes and attach said two end members to said side wall or similar portions in a secure manner, thereby providing structural rigidity and/or support for said support tray or deck support framework or similar component and/or for said vibrating screen.

12. The support tray or deck support framework or similar component of claim 8 wherein said one or more elongated tubular members and/or said one or more tubular extensions and/or said two end members are made of material selected from the group consisting of plastics and glass fiber reinforced substances and carbon fiber reinforced substances and aramid fiber reinforced substances and ceramic substances and metallic ceramic substances and rubber substances and reinforced rubber substances and rubber composite substances.

13. The support tray or deck support framework or similar component of claim 8 wherein said fluid supply and tubular conduit includes one or more flanged tubular members, said one or more flanged tubular members each having at least one tubular portion and an essentially planar surface portion, whereby said essentially planar surface portion is attached to either of said side wall or similar portions and/or to either of said two end members, and is essentially aligned with any of said holes or slots or passageways in either of said side wall or similar portions and/or is essentially aligned with either of said two opposed open end portions of said one or more elongated tubular members, whereby said one or more flanged tubular members convey said fluids and/or fluid like substances to said support tray or deck support framework or similar component, whereby one or more removable extensions of said support tray or deck support framework or similar component providing reinforcement at or near the mounting location of each of said one or more flanged tubular members for either or both of said side wall or similar portions and/or for either or both of said end members is obtained.

14. The support tray or deck support framework or similar component of claim 8 wherein said fluid supply and tubular conduit includes one or more threaded tubular members and mated receiving threads for each of said one or more threaded tubular members, said mated receiving threads essentially located in or near said holes or slots or passageways in either of said side wall or similar portions and/or essentially located in or near either or both of said two end members and/or essentially located in or near either of said two opposed open end portions of said one or more elongated tubular members, wherein said one or more threaded tubular members are removable extensions of said support tray or deck support framework or similar component facilitating the supply of said fluids or fluid like substances and also facilitating the easier removal and/or installation of said support tray or deck support framework or similar component within said vibrating screen or similar device.

15. A method for spraying fluids or fluid like substances within a vibrating screen or similar device having oppositely oriented planar side wall or similar portions, comprising the steps of:

(a) providing one or more hollow tubular members as part of a structurally supporting component and/or a plurality of support trays and/or a continuous deck support framework or a similar device located within and essentially between said side wall or similar portions of said vibrating screen or similar device, said supporting component and/or plurality of support trays and/or continuous deck support framework having one or more holes allowing access to said hollow tubular members, and (b) providing one or more outlet ports in predetermined locations in the wall portion of each of said one or more hollow tubular members, and (c) providing access to either or both open end portions of said one or more hollow tubular members or to one or more tubular extensions of said one or more hollow tubular members at or from areas outside of said vibrating screen or similar device including one or more holes or slots or passageways in said side wall or similar portions of said vibrating screen or similar device, whereby said one or more holes or slots or passageways in said side wall or similar portions convey or provide access for the conveyance of fluids or fluid like substances to the inside portions of said one or more hollow tubular members, and (d) providing a source of pressurized fluid or fluid like substances at areas outside said vibrating screen or similar device to said open end portions of said one or more hollow tubular members or said one or more tubular extensions of said one or more hollow tubular members through or past said one or more holes or slots or passageways in said side wall or similar portions, causing said fluids or fluid like substances to flow through said one or more hollow tubular members and to exit at said outlet ports in said wall of said one or more hollow tubular members, whereby said fluids or fluid like substances are distributed essentially within said vibrating screen or similar device thereby employing a structurally supporting portion of said vibrating screen or similar device as both a stressed structural member and as a means for conveying fluids for distribution within a vibrating screen or similar device.

* * * * *

UNITED STATES PATENT AND TRADEMARK OFFICE

CERTIFICATE OF CORRECTION

PATENT NO. : 5,931,310
DATED : Aug. 3, 1999
INVENTOR(S) : Duggan, John C.

It is certified that error appears in the above-identified patent and that said Letters Patent is hereby corrected as shown below:

Col. 3, line 7, change 'same' to -some-.
Col. 3, line 17, change 'sane' to -some-.

Col. 5, line 33, change '4' to -1-.
Col. 5, line 37, change '4' to -1-.
Col. 5, line 38, change '4' to -1- first occurrence.
Col. 5, line 38, change '4' to -1- second occurrence.
Col. 5, line 42, change '4' to -1-.
Col. 5, line 44, change '4' to -1-.
Col. 5, line 51, change '4' to -1-.
Col. 5, line 54, change '4' to -1-.
Col. 5, line 65, change '4' to -1-.
Col. 5, line 67, change '4' to -1-.

Col. 6, line 5, change '4' to -1-.
Col. 6, line 9, change '4' to -1-.
Col. 6, line 12, change '4' to -1-.
Col. 6, line 22, change '4' to -1-.
Col. 6, line 23, change '4' to -1-.
Col. 6, line 27, change '4' to -1-.
Col. 6, line 29, change '4' to -1-.
Col. 6, line 34, change '4' to -1-.
Col. 6, line 37, change '4' to -1-.
Col. 6, line 48, change '4' to -1-.
Col. 6, line 55, change '4' to -1-.
Col. 6, line 57, change '4' to -1-.
Col. 6, line 61, change '4' to -1-.
Col. 6, line 63, change '4' to -1-.
Col. 6, line 65, change '4' to -1-.

UNITED STATES PATENT AND TRADEMARK OFFICE

CERTIFICATE OF CORRECTION

PATENT NO. : 5,931,310

DATED : August 3, 1999

INVENTOR(S) : Duggan, John C.

It is certified that error appears in the above-identified patent and that said Letters Patent is hereby corrected as shown below:

Col. 7, line 30, change '10A' to -2-.
Col. 7, line 36, change '10A' to -2-.
Col. 7, line 37, change '10A' to -2-.
Col. 7, line 41, change '10A' to -2-.
Col. 7, line 42, change '10A' to -2-.
Col. 7, line 43, change '10A' to -2-.
Col. 7, line 54, change '10A' to -2-.
Col. 7, line 57, change '10A' to -2-.
Col. 7, line 58, change '10A' to -2-.
Col. 7, line 61, change '10A' to -2-.

Col. 8, line 4, change '10A' to -2-.
Col. 8, line 11, change '10A' to -2-.
Col. 8, line 24, change '10A' to -2-.
Col. 8, line 42, change '10A' to -2-.
Col. 8, line 51, change '10A' to -2-.
Col. 8, line 62, change '10A' to -2-.
Col. 8, line 66, change '10A' to -2-.

Col. 9, line 8, change '10A' to -2-.
Col. 9, line 8, change '10C and 10D' to -4 and 5-.
Col. 9, line 10, change '10A' to -2-.
Col. 9, line 11, change '10A' to -2-.
Col. 9, line 21, change '10A' to -2-.
Col. 9, line 47, change '10A' to -2-.
Col. 9, line 49, change '10A' to -2-.
Col. 9, line 54, change '10A' to -2-.
Col. 9, line 57, change '10A' to -2-.

UNITED STATES PATENT AND TRADEMARK OFFICE

CERTIFICATE OF CORRECTION

PATENT NO. : 5,931,310
DATED : August 3, 1999
INVENTOR(S) : Duggan, John C.

It is certified that error appears in the above-identified patent and that said Letters Patent is hereby corrected as shown below:

Col. 10, line 3, change '10C' to -4-.
Col. 10, line 7, change '10A' to -2-.
Col. 10, line 17, change '10A' to -2-.
Col. 10, line 32, change 'node' to -mode-.

Col. 11, line 6, change '10A' to -2-.
Col. 11, line 9, change '10A' to -2-.
Col. 11, line 39, change '10A' to -2-.
Col. 11, line 43, change '10A' to -2-.

Col. 12, line 42, change '10B' to -3-.
Col. 12, line 47, change '10B' to -3-.
Col. 12, line 48, change '10B' to -3-.
Col. 12, line 52, change '10B' to -3-.
Col. 12, line 57, change '10B' to -3-.
Col. 12, line 59, change '10B' to -3-.
Col. 12, line 66, change '10B' to -3-, first occurrence.
Col. 12, line 66, change '10B' to - 3-, second occurrence.

Col. 13, line 3, change '10B' to -3-.
Col. 13, line 8, change '10B' to -3-.
Col. 13, line 12, change '10B' to -3-.
Col. 13, line 23, change '10B' to -3-.
Col. 13, line 30, change '10B' to -3-.
Col. 13, line 31, change '10B' to -3-.
Col. 13, line 38, change '10B' to -3-.

UNITED STATES PATENT AND TRADEMARK OFFICE

CERTIFICATE OF CORRECTION

PATENT NO. : 5,931,310

DATED : August 3, 1998

INVENTOR(S) : Duggan, John C.

It is certified that error appears in the above-identified patent and that said Letters Patent is hereby corrected as shown below:

Col. 13, line 41, change '10B' to -3-.
Col. 13, line 44, change '10B' to -3-.
Col. 13, line 52, change '10B' to -3-.
Col. 13, line 59, change '10B' to -3-.
Col. 13, line 63, change '10B' to -3-.

Col. 14, line 9, change '10B' to -3-.
Col. 14, line 30, change '10A' to -2-.
Col. 14, line 30, change '10B' to -3-.
Col. 14, line 39, change '10C' to -4-.
Col. 14, line 42, change '10C' to -4-.
Col. 14, line 43, change '10C' to -4-.
Col. 14, line 46, change '10A' to -2-.
Col. 14, line 46, change '10B' to -3-.
Col. 14, line 57, change '10A' to -2-.
Col. 14, line 59, change '10C' to -4-.
Col. 14, line 60, change '10C' to -4-.
Col. 14, line 61, change '10C' to -4-.

Col. 15, line 6, change '10C' to -4-.
Col. 15, line 8, change '10A and 10B' to -2 and 3-.
Col. 15, line 9, change '10A' to -2-.
Col. 15, line 11, change '10C' to -4-.
Col. 15, line 14, change '10A' to -2-.
Col. 15, line 16, change '10C' to -4-.
Col. 15, line 29, change '10C' to -4-.
Col. 15, line 40, change '10C' to -4-.
Col. 15, line 42, change '10C' to -4-.
Col. 15, line 56, change '10C' to -4-.

UNITED STATES PATENT AND TRADEMARK OFFICE

CERTIFICATE OF CORRECTION

PATENT NO. : 5,931,310
DATED : August 3, 1999
INVENTOR(S) : Duggan, John C.

It is certified that error appears in the above-identified patent and that said Letters Patent is hereby corrected as shown below:

Col. 16, line 12, change '10C' to -4-.
Col. 16, line 17, change '10C' to -4-.
Col. 16, line 21, change '10C' to -4-.
Col. 16, line 23, change '10C' to -4-.
Col. 16, line 30, change '10A/10B' to -2/3-.
Col. 16, line 39, change '10A' to -2-.
Col. 16, line 41, change '10C' to -4-.
Col. 16, line 51, change '10A' to -2-.
Col. 16, line 56, change '10D' to -5-.
Col. 16, line 60, change '10D' to -5-.
Col. 16, line 62, change '10A' to -2-.
Col. 16, line 64, change '10B' to -3-.
Col. 16, line 65, change '10D' to -5-.

Col. 17, line 1, change '10D' to -5-.
Col. 17, line 3, change '10D' to -5-.
Col. 17, line 6, change '10D' to -5-.
Col. 17, line 9, change '10D' to -5-.
Col. 17, line 16, change '10A and 10C' to -2 and 4-.
Col. 17, line 21, change '10D' to -5-.
Col. 17, line 25, change '10D' to -5-.
Col. 17, line 30, change '10D' to -5-.
Col. 17, line 33, change '10D' to -5-.
Col. 17, line 41, change '10D' to -5-.
Col. 17, line 43, change '10A' to -2-.
Col. 17, line 46, change '10A and 10C' to -2 and 4-.
Col. 17, line 48, change '10D' to -5-.
Col. 17, line 48, change '10A' to -2-.
Col. 17, line 49, change '10C' to -4-.

UNITED STATES PATENT AND TRADEMARK OFFICE

CERTIFICATE OF CORRECTION

PATENT NO. : 5,931,310

DATED : August 3, 1999

INVENTOR(S) : Duggan, John C.

It is certified that error appears in the above-identified patent and that said Letters Patent is hereby corrected as shown below:

Col. 17, line 49, change '10D' to -5-.
Col. 17, line 51, change '10D' to -5-.
Col. 17, line 53, change '10D' to -5-.
Col. 17, line 56, change '10D' to -5-.
Col. 17, line 65, change '10D' to -5-.
Col. 17, line 67, change '10A or 10B' to -2 or 3-.

Col. 18, line 10, change '10D' to -5-.
Col. 18, line 13, change '10D' to -5-.
Col. 18, line 18, change '10C' to -4-.
Col. 18, line 19, change '10C' to -4-.
Col. 18, line 19, change '10D' to -5-, first occurrence.
Col. 18, line 19, change '10D' to -5-, second occurrence
Col. 18, line 22, change '10B' to -3-.
Col. 18, line 22, change '10A' to -2-.
Col. 18, line 24, change '10A' to -2-.
Col. 18, line 25, change '10B' to -3-.
Col. 18, line 26, change '10C' to -4-.
Col. 18, line 26, change '10D' to -5-.
Col. 18, line 27, change '10A' to -2-.
Col. 18, line 28, change '10B' to -3-.
Col. 18, line 30, change '10C' to -4-.
Col. 18, line 32, change '10C' to -4-.
Col. 18, line 32, change '10D' to -5-.
Col. 18, line 43, change '10D' to -5-.
Col. 18, line 46, change '10B' to -3-.
Col. 18, line 46, change '10A' to -2-.
Col. 18, line 47, change '10E' to -6-.
Col. 18, line 49, change '10E' to -6-.

UNITED STATES PATENT AND TRADEMARK OFFICE

CERTIFICATE OF CORRECTION

PATENT NO. : 5,931,310

DATED : August 3, 1999

INVENTOR(S) : Duggan, John C.

It is certified that error appears in the above-identified patent and that said Letters Patent is hereby corrected as shown below:

Col. 18, line 51, change '10E' to -6-.
Col. 18, line 58, change '10E' to -6-.
Col. 18, line 59, change '10E' to -6-.
Col. 18, line 59, change '10A' to -2-.
Col. 18, line 60, change '10A' to -2-.
Col. 18, line 62, change '10A' to -2-.
Col. 18, line 62, change '10E' to -6-.
Col. 18, line 64, change '10C' to -4-.
Col. 18, line 65, change '10F' to -7-.
Col. 18, line 67, change '10F' to -7-.

Col. 19, line 1, change '10F' to -7-.
Col. 19, line 7, change '10F' to -7-.
Col. 19, line 8, change '10F' to -7-.
Col. 19, line 9, change '10B' to -3-, first occurrence.
Col. 19, line 9, change '10B' to -3-, second occurrence.
Col. 19, line 11, change '10B' to -3-.
Col. 19, line 12, change '10F' to -7-.
Col. 19, line 13, change '10C' to -4-.
Col. 19, line 22, change '10A' to -2-.
Col. 19, line 22, change '10F' to -7-.

UNITED STATES PATENT AND TRADEMARK OFFICE

CERTIFICATE OF CORRECTION

PATENT NO. : 5,931,310
DATED : August 3, 1999
INVENTOR(S) : Duggan, John C.

It is certified that error appears in the above-identified patent and that said Letters Patent is hereby corrected as shown below:

Col. 20, line 20, change '10B' to -3-.
Col. 20, line 27, change '10B' to -3-.
Col. 20, line 32, change '10B' to -3-.
Col. 20, line 34, change '10B' to -3-.
Col. 20, line 35, change '10B' to -3-.
Col. 20, line 36, change '10A' to -2-.
Col. 20, line 42, change '10A' to -2-.
Col. 20, line 61, change '10C' to -4-.
Col. 20, line 61, change '10D' to -5-.
Col. 20, line 64, change '10A' to -2-.
Col. 20, line 64, change '10F' to -7-.

Col. 21, line 31, change '10C' to -4-.
Col. 21, line 31, change '10F' to -7-.
Col. 21, line 32, change '10D' to -5-.
Col. 21, line 36, change '10B' to -3-.

Signed and Sealed this

Twenty-second Day of February, 2000

*Attest:*

Q. TODD DICKINSON

*Attesting Officer*

*Commissioner of Patents and Trademarks*